US010101682B2

(12) United States Patent
Tsujihiro

(10) Patent No.: US 10,101,682 B2
(45) Date of Patent: Oct. 16, 2018

(54) ELECTROSTATIC LATENT IMAGE DEVELOPING TONER

(71) Applicant: KYOCERA Document Solutions Inc., Osaka (JP)

(72) Inventor: Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/858,481

(22) Filed: Dec. 29, 2017

(65) Prior Publication Data

US 2018/0210357 A1 Jul. 26, 2018

(30) Foreign Application Priority Data

Jan. 26, 2017 (JP) ..... 2017-012072

(51) Int. Cl.
*G03G 9/08* (2006.01)
*G03G 9/087* (2006.01)
*G03G 9/093* (2006.01)

(52) U.S. Cl.
CPC ..... *G03G 9/0825* (2013.01); *G03G 9/08708* (2013.01); *G03G 9/08755* (2013.01); (Continued)

(58) Field of Classification Search
CPC ..... G03G 9/0825; G03G 9/09364; G03G 9/08708; G03G 9/08755; G03G 9/09371; (Continued)

(56) References Cited

U.S. PATENT DOCUMENTS 9,612,544 B2 4/2017 Nakagawa et al.
2016/0179025 A1 6/2016 Nakagawa et al.

FOREIGN PATENT DOCUMENTS

JP 2015-194734 A 11/2015

*Primary Examiner* — Thorl Chea

(74) *Attorney, Agent, or Firm* — Studebaker & Brackett PC

(57) ABSTRACT

Toner particles each include a toner core, a shell layer covering a surface of the toner core, and a plurality of wax particles. The toner core contains a binder resin and does not contain a wax. The wax particles are each located on a surface of the shell layer. The toner core and each of the wax particles are bonded together through covalent bonds within the shell layer. The covalent bonds include a first amide bond and a second amide bond. The shell layer contains a vinyl resin. The vinyl resin includes a constitutional unit (1-1), a constitutional unit (1-2), and a constitutional unit (1-3). An amide bond included in the constitutional unit (1-1) is the first amide bond. An amide bond included in the constitutional unit (1-2) is the second amide bond.

(1-1)

(1-2)

(Continued)

-continued
(1-3)
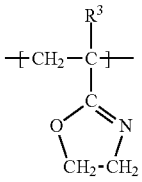
5 Claims, 3 Drawing Sheets
(52) U.S. Cl.
CPC ..... *G03G 9/08782* (2013.01); *G03G 9/09314* (2013.01); *G03G 9/09321* (2013.01); *G03G 9/09364* (2013.01); *G03G 9/09371* (2013.01); *G03G 9/09392* (2013.01)
(58) Field of Classification Search
CPC ..... G03G 9/08782; G03G 9/09321; G03G 9/09314; G03G 9/09392
See application file for complete search history.

ELECTROSTATIC LATENT IMAGE DEVELOPING TONER

INCORPORATION BY REFERENCE

The present application claims priority under 35 U.S.C. § 119 to Japanese Patent Application No. 2017-012072, filed on Jan. 26, 2017. The contents of this application are incorporated herein by reference in their entirety.

BACKGROUND

The present disclosure relates to an electrostatic latent image developing toner.

Capsule toners are known as toner particles included in a toner. An example of the capsule toners includes a toner core and a shell layer covering a surface of the toner core. An example of the toner core contains a binder resin, a colorant, and a wax, for example.

SUMMARY

An electrostatic latent image developing toner according to the present disclosure is positively chargeable and includes a plurality of positively chargeable toner particles. The toner particles each include a toner core, a shell layer covering a surface of the toner core, and a plurality of wax particles. The toner core contains a binder resin and does not contain a wax. The wax particles are each located on a surface of the shell layer. The toner core and each of the wax particles are bonded together through covalent bonds within the shell layer. The covalent bonds include a first amide bond and a second amide bond. The shell layer contains a vinyl resin. The vinyl resin includes a constitutional unit represented by formula (1-1) below, a constitutional unit represented by formula (1-2) below, and a constitutional unit represented by formula (1-3) below. An amide bond included in the constitutional unit represented by the formula (1-1) is the first amide bond. An amide bond included in the constitutional unit represented by the formula (1-2) is the second amide bond.

(1-1)

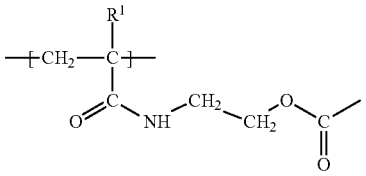

In the formula (1-1), $R^1$ represents a hydrogen atom or an optionally substituted alkyl group. In the formula (1-1), a dangling bond of a carbon atom bonded with two oxygen atoms is connected with an atom constituting the binder resin.

(1-2)

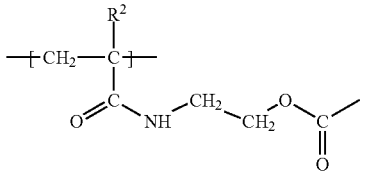

In the formula (1-2), $R^2$ represents a hydrogen atom or an optionally substituted alkyl group. In the formula (1-2), a dangling bond of a carbon atom bonded with two oxygen atoms is connected with an atom constituting a wax contained in the wax particles.

(1-3)

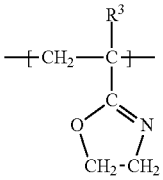

In the formula (1-3), $R^3$ represents a hydrogen atom or an optionally substituted alkyl group.

DETAILED DESCRIPTION

Figure 1:
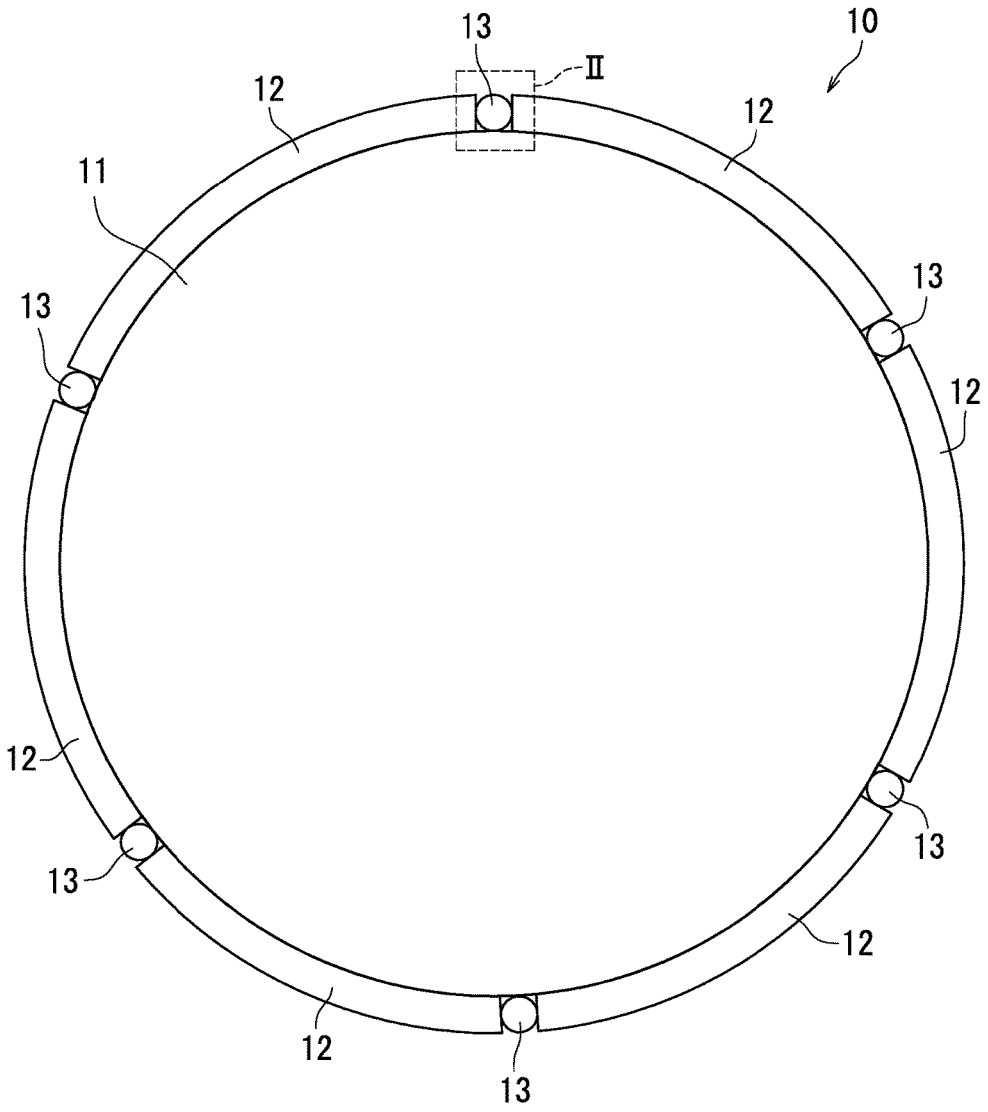
FIG. 1 is a cross-sectional view illustrating structure of a toner particle according to an embodiment of the present disclosure.

The following describes an embodiment of the present disclosure. Evaluation results (values indicating shape, physical properties, and the like) for toner cores, toner mother particles, toner particles, and external additive particles described below are each a number average of values measured for a suitable number of particles, unless otherwise stated. Here, the toner mother particles refer to toner particles that do not include an external additive.

Also, a number average particle diameter of a powder is a number average value of equivalent circle diameters of primary particles (i.e., diameters of circles having the same areas as projected areas of the particles) measured using a microscope, unless otherwise stated. A measurement value of a volume median diameter ($D_{50}$) of a powder is a value measured based on the Coulter principle (electrical sensing zone technique) using "Coulter Counter Multisizer 3" manufactured by Beckman Coulter, Inc., unless otherwise stated.

Measurement values of an acid value and a hydroxyl value are values measured in accordance with "Japan Industrial Standard (JIS) K0070-1992", unless otherwise stated. Measurement values of a number average molecular weight (Mn) and a mass average molecular weight (Mw) are values measured using gel permeation chromatography, unless otherwise stated. Values of a glass transition point (Tg) and a melting point (Mp) are measured using a differential scanning calorimeter ("DSC-6220" manufactured by Seiko Instruments Inc.), unless otherwise stated. A value of a softening point (Tm) is measured using a capillary rheometer ("CFT-500D" manufactured by Shimadzu Corporation), unless otherwise stated.

Also, the term "-based" may be appended to the name of a chemical compound in order to form a generic name encompassing both the chemical compound itself and derivatives thereof. When the term "-based" is appended to the name of a chemical compound used in the name of a polymer, the term indicates that a constitutional unit of the polymer originates from the chemical compound or a derivative thereof. The term "(meth)acryl" is used as a generic term for both acryl and methacryl.

Also, chargeability indicates chargeability at triboelectric charging, unless otherwise stated. In the following description, "strong positive chargeability" indicates strong positive chargeability by triboelectric charging. Strength of positive chargeability by triboelectric charging or strength of negative chargeability by triboelectric charging can be known from a known triboelectric series.

An electrostatic latent image developing toner (hereinafter may be simply referred to as a "toner") according to the present embodiment may constitute a one-component developer or a two-component developer together with an electrostatic latent image developing carrier (hereinafter will be simply referred to as a "carrier").

The toner according to the present embodiment can be used for image formation using an electrophotographic apparatus (an image forming apparatus), for example. The following method is an example of methods for forming an image using the toner according to the present embodiment. First, a charger uniformly charges a photosensitive layer of a photosensitive drum. Next, a light exposure device forms an electrostatic latent image on the photosensitive layer based on image data. Subsequently, a developing device develops the electrostatic latent image using a toner borne on a magnetic roller. Through the above, a toner image is formed on a surface of the photosensitive layer. Subsequently, a transfer device transfers the toner image onto a recording medium. Thereafter, a fixing device fixes toner particles included in the toner image on the recording medium (fixing process).

[Configuration of Electrostatic Latent Image Developing Toner According to Present Embodiment]

The toner according to the present embodiment is positively chargeable and includes a plurality of positively chargeable toner particles. The toner particles each include a toner core, a shell layer, and a plurality of wax particles. The toner core contains a binder resin but does not contain a wax. The shell layer covers a surface of the toner core. The wax particles are each located on a surface of the shell layer.

In the present embodiment, the wax particles are not included in the toner core, but are located on the surface of the shell layer, as described above. Therefore, the wax particles are capable of functioning as a releasing agent in the fixing process. When the wax particles function as the releasing agent in the fixing process, occurrence of hot offset can be prevented. Also, winding of the recording medium around the fixing device can be prevented.

Also, in each of the toner particles, the toner core and each of the wax particles are bonded together through covalent bonds within the shell layer. Therefore, contamination by wax can be prevented. More specifically, the wax particles are prevented from separating from the toner particle before the fixing process. As a result, it is possible to prevent adhesion of wax particles separated from the toner particle to surfaces of components of the image forming apparatus. Therefore, occurrence of image defects can be prevented. For example, generation of a dash mark can be prevented. Also, when the toner according to the present embodiment constitutes a two-component developer, it is possible to prevent adhesion of wax particles separated from the toner particle to surfaces of carrier particles. Therefore, reduction in charge amount of the toner can be prevented.

The following further describes the toner particles. The covalent bonds (hereinafter referred to as "specific covalent bonds") within the shell layer through which the toner core and each of the wax particles are bonded tougher include a first amide bond and a second amide bond. The shell layer contains a vinyl resin.

Here, the vinyl resin is a homopolymer or a copolymer of a vinyl compound. The vinyl compound has at least one of a vinyl group ($CH_2{=}CH{-}$), a vinylidene group ($CH_2{=}C<$), and a vinylene group ($-CH{=}CH-$) within a molecule. When addition polymerization reaction is caused by cleavage of a carbon-to-carbon double bond ($C{=}C$) included in the functional group such as the vinyl group, the vinyl compound becomes a macromolecule (the vinyl resin).

In the present embodiment, the vinyl resin includes a constitutional unit (hereinafter referred to as a "constitutional unit (1-1)") represented by formula (1-1) shown below, a constitutional unit (hereinafter referred to as a "constitutional unit (1-2)") represented by formula (1-2) shown below, and a constitutional unit (hereinafter referred to as a "constitutional unit (1-3)") represented by formula (1-3) shown below. Note that the amide bond [$C({=}O){-}NH$] included in the constitutional unit (1-1) is the first amide bond. The amide bond [$C({=}O){-}NH$] included in the constitutional unit (1-2) is the second amide bond. Hereinafter, the vinyl resin including the constitutional units (1-1), (1-2), and (1-3) will be referred to as a "specific vinyl resin".

(1-1)

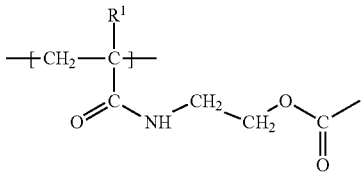

In the formula (1), $R^1$ represents a hydrogen atom or an optionally substituted alkyl group. The alkyl group includes a straight chain alkyl group, a branched chain alkyl group, and a cyclic alkyl group. An example of substituents of the alkyl group is a phenyl group. Preferably, $R^1$ represents a hydrogen atom, a methyl group, an ethyl group, or an isopropyl group. Also, in the formula (1-1), a dangling bond of a carbon atom bonded with two oxygen atoms is connected with an atom constituting the binder resin. The atom constituting the binder resin is for example an atom bonded with a first carboxyl group described further below.

(1-2)

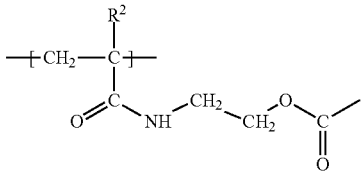

In the formula (1-2), $R^2$ represents a hydrogen atom or an optionally substituted alkyl group. The alkyl group includes a straight chain alkyl group, a branched chain alkyl group, and a cyclic alkyl group. An example of substituents of the alkyl group is a phenyl group. Preferably, $R^2$ represents a hydrogen atom, a methyl group, an ethyl group, or an isopropyl group. Also, in the formula (1-2), a dangling bond of a carbon atom bonded with two oxygen atoms is connected with an atom constituting a wax contained in the wax particles. The atom constituting the wax is for example an atom bonded with a second carboxyl group described further below.

(1-3)

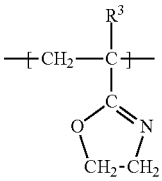

In the formula (1-3), $R^3$ represents a hydrogen atom or an optionally substituted alkyl group. The alkyl group includes a straight chain alkyl group, a branched chain alkyl group, and a cyclic alkyl group. An example of substituents of the alkyl group is a phenyl group. Preferably, $R^3$ represents a hydrogen atom, a methyl group, an ethyl group, or an isopropyl group.

The shell layer is preferably formed by the following method. Specifically, toner cores, a dispersion of wax particles, and a solution of a vinyl resin for shell layer formation are initially prepared. The toner cores and the wax particles to be prepared each have a carboxyl group on a surface thereof. The vinyl resin for shell layer formation includes the constitutional unit (1-3). Therefore, the vinyl resin for shell layer formation has a plurality of (ring unopened) oxazoline groups. Note that the vinyl resin for shell layer formation is obtained through polymerization of a compound represented by formula (1-4) shown further below. The constitutional unit (1-3) is derived from the compound represented by the formula (1-4) shown further below.

Next, the toner cores, the dispersion of the wax particles, and the solution of the vinyl resin for shell layer formation are mixed together. After a temperature of the resultant dispersion is increased to a specific temperature while stirring the resultant dispersion, the temperature of the dispersion is maintained at the specific temperature for a specific time.

The specific temperature is not lower than a temperature at which an amide bond is formed through reaction between the first carboxyl group (the carboxyl group present on the surface of the toner core, more specifically, the carboxyl group of the binder resin, which is present on the surface of the toner core) and the oxazoline group included in the constitutional unit (1-3), and an amide bond is formed through reaction between the second carboxyl group (the carboxyl group present on the surface of the wax particle, more specifically, the carboxyl group of the wax contained in the wax particle, which is present on the surface of the wax particle) and the oxazoline group included in the constitutional unit (1-3). Therefore, the following reaction is thought to proceed while maintaining the temperature of the dispersion at the specific temperature. Specifically, an oxazoline group among the plurality of oxazoline groups included in the constitutional unit (1-3) is ring-opened through reaction with the first carboxyl group. Through the above, the first amide bond is formed. Therefore, the constitutional unit (1-1) is formed. Further, an oxazoline group among the rest of the oxazoline groups is ring-opened through reaction with the second carboxyl group. Through the above, the second amide bond is formed. Therefore, the constitutional unit (1-2) is formed. Among the plurality of oxazoline groups, oxazoline groups that react with neither of the first carboxyl group and the second carboxyl group are not ring-opened (constitutional unit (1-3)). Thus, the shell layer is formed.

Note that the oxazoline group is known to have strong positive chargeability. The specific vinyl resin including the constitutional unit (1-3) has the plurality of (ring unopened) oxazoline groups. Therefore, a positively chargeable toner excellent in charge characteristics can be obtained.

Presence of the specific covalent bonds can be confirmed by the following method, for example. Specifically, a specific amount of the toner particles (sample) are dissolved in a solvent. The resultant solution is placed in a test tube for nuclear magnetic resonance (NMR) measurement, and a $^1$H-NMR spectrum is measured using an NMR apparatus. Here, it is known that in the $^1$H-NMR spectrum, a triplet signal derived from a secondary amide appears around a chemical shift δ of 6.5. Therefore, when a triplet signal is observed around a chemical shift δ of 6.5 in the measured $^1$H-NMR spectrum, it is presumed that the specific covalent bonds are present in the toner particles. Therefore, it is presumed that the toner core and each of the wax particles are bonded together through the specific covalent bonds. An example of measurement conditions of the $^1$H-NMR spectrum is as follows.

<Example of Measurement Conditions of $^1$H-NMR Spectrum>

NMR apparatus: Fourier transform nuclear magnetic resonance apparatus (FT-NMR) ("JNM-AL400" manufactured by JEOL Ltd.)

Test tube for NMR measurement: 5-mm test tube

Solvent: Deuterated chloroform (1 mL)

Temperature of sample: 20° C.

Mass of sample: 20 mg

Number of accumulation: 128 times

Internal standard substance of chemical shift: Tetramethylsilane (TMS)

[Preferable Configuration of Electrostatic Latent Image Developing Toner According to Present Embodiment]

The following describes preferable configuration of the toner according to the present embodiment.

<Toner Core>

As described above, the toner core contains the binder resin. Preferably, an acid value of the binder resin is at least 1 mgKOH/g and no greater than 10 mgKOH/g. When the acid value of the binder resin is at least 1 mgKOH/g, the reaction between the first carboxyl group and the oxazoline group proceeds easily, and therefore, the first amide bond is formed easily. When the acid value of the binder resin is no greater than 10 mgKOH/g, the resultant toner is excellent in charge stability irrespective of an environment in which image formation is performed. For example, decrease in charge amount of the toner can be prevented even when image formation is performed in a high-humidity environment. More preferably, the acid value of the binder resin is at least 3 mgKOH/g and no greater than 7 mgKOH/g. The acid value of the binder resin is preferably measured by any of methods described in "Method for Measuring Acid Value of Binder Resin" and "Method for Measuring Acid Value" in examples further below and a method in accordance with any of these methods.

Further preferably, the binder resin includes a resin that has an acid value of at least 1 mgKOH/g and no greater than 10 mgKOH/g. In the above configuration, the acid value of the binder resin tends to be at least 1 mgKOH/g and no greater than 10 mgKOH/g. More specifically, the binder resin preferably includes at least one of a polyester resin and a styrene-acrylic acid-based resin.

<Shell Layer>

Preferably, the shell layer further contains a resin (hereinafter referred to as "another resin A") other than the specific vinyl resin. The other resin A preferably includes a positively chargeable resin and a hydrophobic resin. Here, the "positively chargeable resin" refers to a resin that has stronger positive chargeability than the binder resin. When two or more resins are used as the binder resin, the positively chargeable resin has stronger positive chargeability than any of those resins. Also, the "hydrophobic resin" refers to a resin that exhibits stronger hydrophobicity than the positively chargeable resin. When two or more positively chargeable resins are used, the hydrophobic resin exhibits stronger hydrophobicity than any of the positively chargeable resins. When the shell layer further contains the other resin A, a positively chargeable toner that is more excellent in charge characteristics can be obtained. When the shell layer further contains the other resin A, it is preferable that the shell layer has the following structure.

Preferably, the specific vinyl resin is present in a portion of the shell layer located between the toner core and each of the wax particles. Preferably, the other resin A covers a surface region of the toner core exposed from the specific vinyl resin. More preferably, the other resin A surrounds each of the wax particles at a surface of the shell layer. Further preferably, the other resin A does not cover surfaces of the wax particles at the surface of the shell layer. When the surfaces of the wax particles are not covered by the other resin A at the surface of the shell layer, the wax particles tend to function as the releasing agent in the fixing process. Hereinafter, the portion of the shell layer located between the toner core and each of the wax particles may be referred to as an "intervening portion". Also, a portion of the shell layer covering the surface region of the toner core exposed from the intervening portion may be referred to as a "peripheral portion".

Preferably, the intervening portion has a thickness of at least 5 nm and no greater than 10 nm. When the thickness of the intervening portion is at least 5 nm, a sufficient amount of the specific vinyl resin tends to be present in the intervening portion. As a result, the specific covalent bonds tend to be formed. When the thickness of the intervening portion is no greater than 10 nm, the toner particle is prevented from being excessively large. The thickness of the intervening portion refers to a dimension of the intervening portion in a radial direction of the toner particle. The thickness of the intervening portion is preferably measured by a method described in "Method for Measuring Thickness of Shell Layer" in the examples further below or a method in accordance therewith.

Preferably, the peripheral portion has a thickness of at least 3 nm and no greater than 50 nm. When the thickness of the peripheral portion is at least 3 nm, heat-resistant preservation stability of the toner tends to be improved. When the thickness of the peripheral portion is no greater than 50 nm, low-temperature fixability of the toner tends to be improved. More preferably, the peripheral portion has a thickness of at least 10 nm and no greater than 40 nm. The thickness of the peripheral portion refers to a dimension of the peripheral portion in the radial direction of the toner particle. The thickness of the peripheral portion is preferably measured by a method described in "Method for Measuring Thickness of Shell Layer" in the examples further below or a method in accordance therewith.

Preferably, the shell layer has an extended portion. The "extended portion" extends from the intervening portion toward an outer side of the toner particle in the radial direction thereof, and covers a part of the surface of each wax particle. When the second carboxyl group present on the outer side of the toner particle in the radial direction thereof reacts with the oxazoline group, the shell layer tends to have the extended portion. Therefore, the extended portion often contains the specific vinyl resin.

Note that the shell layer may contain the specific vinyl resin only (see example 8 described further below). When the shell layer contains the specific vinyl resin only, the shell layer preferably has a thickness of at least 5 nm and no greater than 10 nm. The thickness of the shell layer is preferably measured by a method described in "Method for Measuring Thickness of Shell Layer" in the examples further below or a method in accordance therewith.

<Wax Particles>

Preferably, the wax particles have a volume median diameter ($D_{50}$) of at least 10 nm and no greater than 150 nm. When the volume median diameter ($D_{50}$) of the wax particles is at least 10 nm, the wax particles can be easily produced. When the volume median diameter ($D_{50}$) of the wax particles is no greater than 150 nm, a space to which an external additive adheres tends to be left at the surface of the shell layer.

The wax particles contain a wax. Hereinafter, the wax contained in the wax particles will be referred to as a "wax B". Preferably, the wax B has an acid value of at least 1 mgKOH/g and no greater than 10 mgKOH/g. When the acid value of the wax B is at least 1 mgKOH/g, the reaction between the second carboxyl group and the oxazoline group proceeds easily, and therefore, the second amide bond is formed easily. When the acid value of the wax B is no greater than 10 mgKOH/g, the resultant toner is excellent in charge stability irrespective of an environment in which image formation is performed. For example, decrease in charge amount of the toner can be prevented even when image formation is performed in a high-humidity environment. More preferably, the wax B has an acid value of at least 1 mgKOH/g and no greater than 6 mgKOH/g. The acid value of the wax B is preferably measured by a method described in the examples further below or a method in accordance therewith.

Further preferably, the wax B includes a wax that has an acid value of at least 1 mgKOH/g and no greater than 10 mgKOH/g. In the above configuration, the acid value of the wax B tends to be at least 1 mgKOH/g and no greater than 10 mgKOH/g. More specifically, the wax B preferably includes a carnauba wax (for example, "Carnauba Wax No. 1" manufactured by S. Kato & Co.). Alternatively, the wax B may include both an ester wax (for example, "NISSAN ELECTOL (registered Japanese trademark) WEP-3" manufactured by NOF Corporation) and a behenic acid (for example, "NAA (registered Japanese trademark)-222S" manufactured by NOF Corporation). The following specifically describes the preferable configuration of the toner according to the present embodiment with reference to the drawings.

[Configuration of Electrostatic Latent Image Developing Toner According to First Specific Example]

Figure 2:
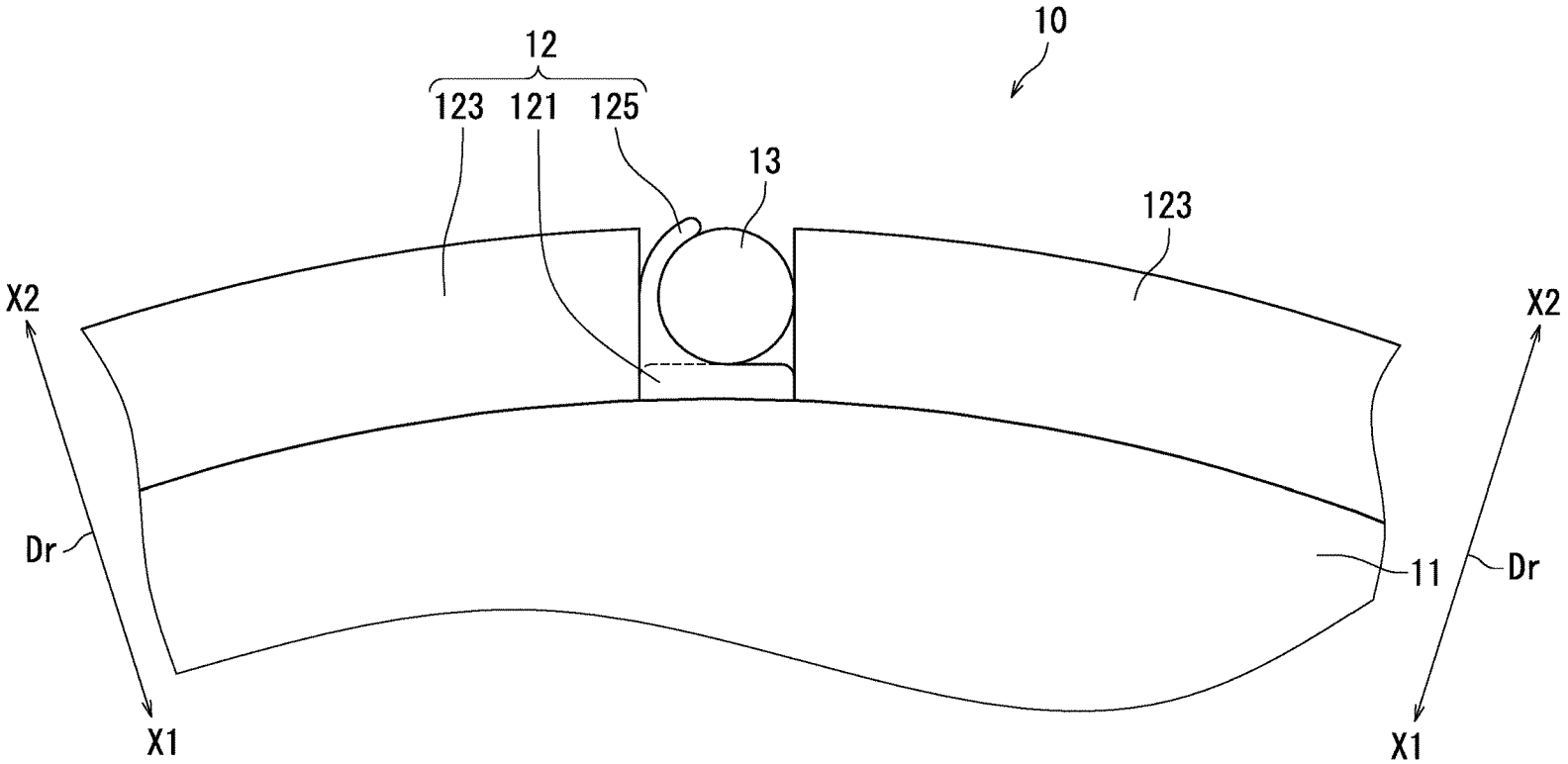
FIG. 2 is a diagram schematically illustrating a region II in FIG. 1.

FIG. 1 is a cross-sectional view illustrating configuration of a toner particle included in a toner according to a first specific example. FIG. 2 is a diagram schematically illustrating a region II in FIG. 1. Note that in FIG. 2, a radial direction of a toner particle 10 is indicated by "Dr", an inner side of the toner particle 10 in the radial direction is indicated by "X1", and an outer side of the toner particle 10 in the radial direction is indicated by "X2".

The toner particle 10 illustrated in FIG. 1 includes a toner core 11, a shell layer 12, and a plurality of wax particles 13. The toner core 11 contains the binder resin and does not contain a wax. The shell layer 12 covers a surface of the toner core 11 and contains the specific vinyl resin. The shell layer 12 may further contain the other resin A in addition to the specific vinyl resin. The wax particles 13 are not included in the toner core 11, but are located on a surface of the shell layer 12. The toner core 11 and each of the wax particles 13 are bonded together through the specific covalent bonds. The specific covalent bonds include the first amide bond and the second amide bond.

As illustrated in FIG. 2, the shell layer 12 has an intervening portion 121, a peripheral portion 123, and an extended portion 125. The intervening portion 121 is located between the toner core 11 and each of the wax particles 13. The peripheral portion 123 covers a surface region of the toner core 11 exposed from the intervening portion 121 (i.e., a surface region of the toner core 11 on which the intervening portion 121 is not provided). The extended portion 125 extends from the intervening portion 121 toward the outer side X2 of the toner particle 10 in the radial direction thereof, and covers a part of a surface of the wax particle 13. The intervening portion 121 and the extended portion 125 each contain the specific vinyl resin. The peripheral portion 123 contains the positively chargeable resin and the hydrophobic resin.

Note that cross-sectional shapes of the intervening portion 121, the peripheral portion 123, and the extended portion 125 are not limited to those illustrated in FIG. 2. Also, a gap may be present or absent between the wax particle 13 and each of the intervening portion 121, the peripheral portion 123 and the extended portion 125. Also, shape profiles of gaps in a cross section are not limited to those illustrated in FIG. 2. Through the above, the configuration of the toner particle included in the toner according to the first specific example has been described with reference to FIGS. 1 and 2. The following describes a preferable method for producing the toner according to the present embodiment.

[Preferable Method for Producing Electrostatic Latent Image Developing Toner According to Present Embodiment]

The method for producing the toner according to the present embodiment preferably includes a process for producing toner mother particles, and more preferably further includes an external addition process. Note that toner particles produced at the same time are thought to have substantially the same configuration as each other.

<1. Process for Producing Toner Mother Particles>

A preferable process for producing toner mother particles include a process for producing toner cores, a process for preparing a dispersion of wax particles, a process for preparing a shell layer formation liquid, and a process for forming a shell layer.

(1-1. Process for Producing Toner Cores)

In the process for producing toner cores, toner cores having the first carboxyl group are produced. The toner cores can be produced easily by a known pulverization method or a known aggregation method.

When the toner cores are produced by the pulverization method, the binder resin and other components are initially mixed together. Here, the other components include at least one of a colorant and a charge control agent, but do not include a wax. The resultant mixture is melt-kneaded using a melt-kneading device (for example, a single-screw or twin-screw extruder). The resultant melt-kneaded product is pulverized and classified. Through the above, the toner cores are obtained. In most cases, the toner cores can be produced more easily by the pulverization method than by the aggregation method.

When the toner cores are produced by the aggregation method, particulates of the binder resin and particulates of other components are initially caused to aggregate in an aqueous medium to form aggregated particles having a desired particle diameter. Here, the particulates of the other components include particulates of a colorant, but do not include particulates of a wax. Through the above, the aggregated particles containing the binder resin and the other components are formed. The resultant aggregated particles are heated to cause coalescence of components contained in the aggregated particles. Through the above, the toner cores are obtained.

Irrespective of the method for producing the toner cores, the binder resin to be used preferably has an acid value of at least 1 mgKOH/g and no greater than 10 mgKOH/g. Through the above, the resultant toner cores tend to have the first carboxyl group.

(1-2. Process for Preparing Dispersion of Wax Particles)

In the process for preparing a dispersion of wax particles, a dispersion of wax particles having the second carboxyl group is prepared. The dispersion of the wax particles is preferably prepared by the following method. Specifically, a liquid containing the wax B and a first solvent is stirred at a first temperature. Through the above, a solution of the wax B is obtained. Thereafter, the solution of the wax B is emulsified. Through the above, the dispersion of the wax particles is obtained.

The first temperature is preferably not lower than a melting temperature of the wax B. More specifically, the first temperature is preferably at least 70° C. and no greater than 120° C. The first solvent preferably includes at least one of toluene, acetone, methyl ethyl ketone, tetrahydrofuran, and water (more specifically, ion exchanged water), for example. The solution of the wax B may further contain a surfactant as necessary. The surfactant is preferably an anionic surfactant.

As conditions of the stirring, for example, a rotational speed is preferably at least 5,000 rpm and no greater than 20,000 rpm, and a stirring time is preferably at least 1 hour and no longer than 5 hours. The emulsification is preferably performed using at least one of a homogenizer (for example, "ULTRA-TURRAX T50" manufactured by IKA Works) and a Gaulin homogenizer (for example, "APV homogenizer model 15M-8TA" manufactured by SPX Corporation). The emulsification is preferably performed in a high-temperature (for example, at least 70° C. and no greater than 120° C.) environment.

(1-3. Process for Preparing Shell Layer Formation Liquid)

In the process for preparing a shell layer formation liquid, a solution of a vinyl resin for shell layer formation is preferably prepared. As the solution of the vinyl resin for shell layer formation, "EPOCROS (registered Japanese trademark) WS-300" manufactured by Nippon Shokubai Co., Ltd. can be used, for example. EPOCROS WS-300 contains a copolymer (a water-soluble cross-linking agent) of 2-vinyl-2-oxazoline and methyl methacrylate. A mass ratio of the monomers constituting the copolymer is: (2-vinyl-2-oxazoline):(methyl methacrylate)=9:1. Here, 2-vinyl-2-oxazoline corresponds to a vinyl compound represented by formula (1-4) shown below where $R^4$ represents a hydrogen atom.

(1-4)

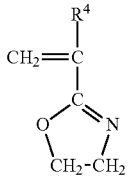

In the formula (1-4), $R^4$ represents a hydrogen atom or an optionally substituted alkyl group. The alkyl group includes a straight chain alkyl group, a branched chain alkyl group, and a cyclic alkyl group. An example of substituents of the alkyl group is a phenyl group. Preferably, $R^4$ represents a hydrogen atom, a methyl group, an ethyl group, or an isopropyl group.

More preferably, a liquid that contains the vinyl resin for shell layer formation and particles containing the other resin A is prepared. Further preferably, a liquid that contains the vinyl resin for shell layer formation, particles containing the positively chargeable resin, and particles containing the hydrophobic resin is prepared. In the following description, the particles containing the positively chargeable resin may be referred to as "resin particles P1". Also, the particles containing the hydrophobic resin may be referred to as "resin particles P2". More specifically, the shell layer formation liquid is preferably prepared by preparing the solution of the vinyl resin for shell layer formation, a dispersion of the resin particles P1, and a dispersion of the resin particles P2, and mixing these solution and dispersions together.

In a process for preparing the dispersion of the resin particles P1, a positively chargeable monomer is preferably polymerized in a first dispersion medium. More preferably, the positively chargeable monomer is polymerized in the presence of a polymerization initiator. Homopolymerization of one type of positively chargeable monomer may be caused, or copolymerization of two or more types of positively chargeable monomers may be caused. Thus, the dispersion of the resin particles P1 is obtained. Note that the first dispersion medium preferably contains water (more specifically, ion exchanged water), for example.

In a process for preparing the dispersion of the resin particles P2, a hydrophobic monomer is preferably polymerized in a second dispersion medium. More preferably, the hydrophobic monomer is polymerized in the presence of a polymerization initiator. Homopolymerization of one type of hydrophobic monomer may be caused, or copolymerization of two or more types of hydrophobic monomers may be caused. Thus, the dispersion of the resin particles P2 is obtained. Note that the second dispersion medium preferably contains water (more specifically, ion exchanged water), for example.

(1-4. Process for Forming Shell Layer)

In the process for forming a shell layer, a shell layer that covers a surface of each toner core is formed. More specifically, the toner cores, a dispersion of wax particles, and the shell layer formation liquid are mixed together at a specific temperature. Here, the specific temperature is not lower than a temperature at which an amide bond is formed through reaction between the first carboxyl group and the oxazoline group, and an amide bond is formed through reaction between the second carboxyl group and the oxazoline group. Through the above, the shell layer is formed, and a dispersion of toner mother particles is obtained. A plurality of the toner mother particles are obtained by performing solid-liquid separation, washing, and drying on the dispersion of the toner mother particles.

Specifically, the toner cores, the dispersion of the wax particles, and the shell layer formation liquid are initially mixed together to obtain a dispersion (hereinafter referred to as a "dispersion E"). Here, materials constituting the shell layer (shell materials) adhere to surfaces of the toner cores in the dispersion E. In order to cause the shell materials to uniformly adhere to the surfaces of the toner cores, it is preferable to achieve a high degree of dispersion of the toner cores in the dispersion E. In order to achieve the high degree of dispersion of the toner cores in the dispersion E, a surfactant may be added to the dispersion E, or the dispersion E may be stirred using a powerful stirring device (for example, "Hivis Disper Mix" manufactured by PRIMIX Corporation).

Next, a temperature of the dispersion E is increased to a specific temperature at a specific heating rate while stirring the dispersion E. Thereafter, the temperature of the dispersion E is maintained at the specific temperature for a specific time while stirring the dispersion E. As described above, the specific temperature is not lower than a temperature at which an amide bond is formed through reaction between the first carboxyl group and the oxazoline group and an amide bond is formed through reaction between the second carboxyl group and the oxazoline group. Therefore, the reaction between the first carboxyl group and the oxazoline group and the reaction between the second carboxyl group and the oxazoline group are thought to proceed while maintaining the temperature of the dispersion E at the specific temperature.

The specific temperature is preferably selected within a range from 50° C. to 100° C. When the specific temperature is not lower than 50° C., the reaction between the first carboxyl group and the oxazoline group and the reaction between the second carboxyl group and the oxazoline group proceed easily. When the specific temperature is not higher than 100° C., melting of resin components through formation of the shell layer can be prevented. The resin components include the binder resin contained in the toner cores, either of the vinyl resin for shell layer formation and the specific vinyl resin, the positively chargeable resin, and the hydrophobic resin.

The specific heating rate is preferably selected within a range from 0.1° C./minute to 3° C./minute, for example. The specific time is preferably selected within a range from 30 minutes to 4 hours, for example. The dispersion E is preferably stirred at a rotational speed of at least 50 rpm and no greater than 500 rpm. Through the above, the reaction between the first carboxyl group and the oxazoline group and the reaction between the second carboxyl group and the oxazoline group proceed easily.

Figure 3:
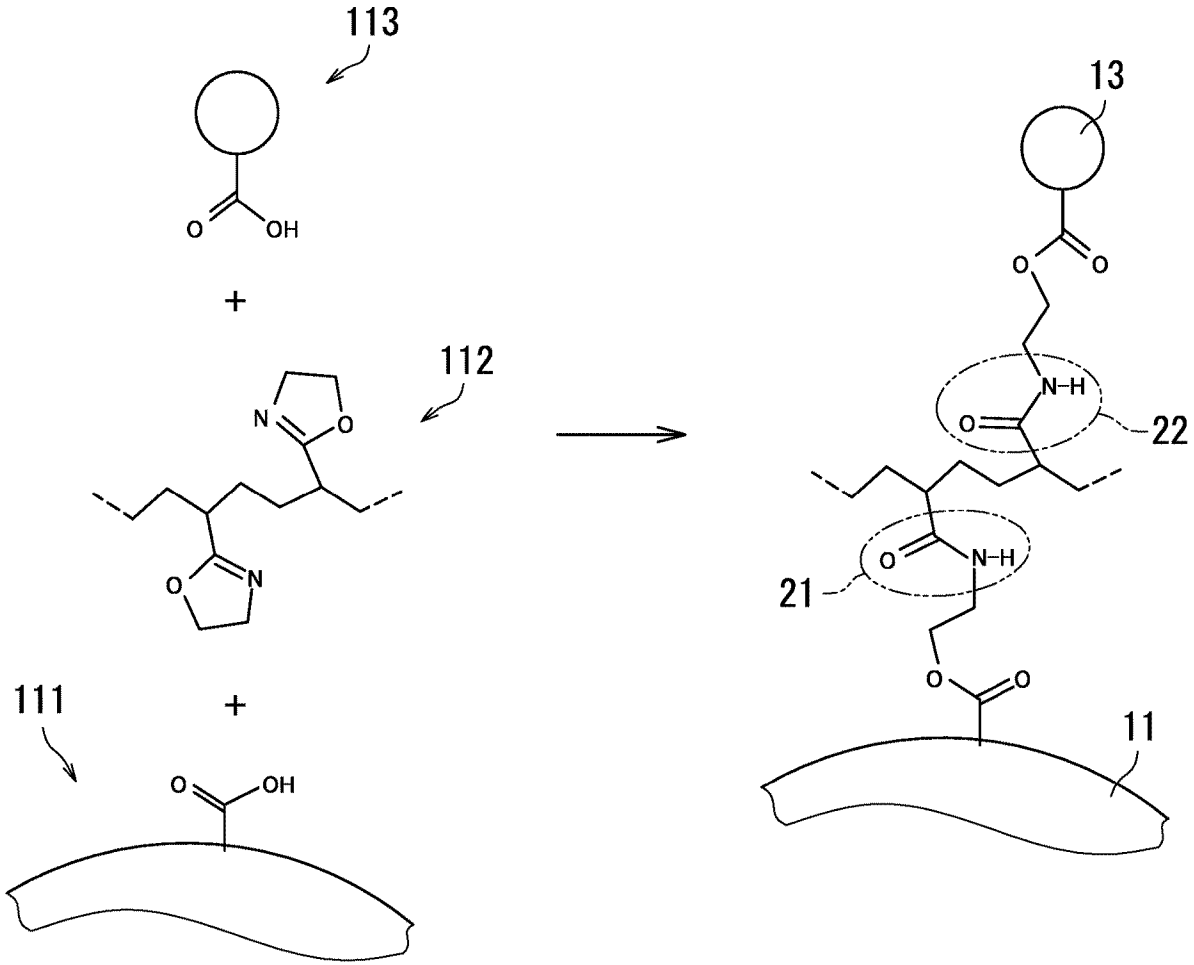
FIG. 3 is a diagram schematically illustrating a process of a method for producing the toner particle according to the embodiment of the present disclosure.

The following specifically describes the process for forming the shell layer with reference to the drawings. FIG. 3 is a diagram schematically illustrating a process in a method for producing the toner particles, and more specifically the process for forming the shell layer. Further specifically, FIG. 3 illustrates a reaction process through which the first carboxyl group and the second carboxyl group are bonded together through the specific covalent bonds. Note that FIG. 3 illustrates a chemical structural formula by omitting some atoms (specifically, by omitting carbon atoms, and hydrogen atoms which bond to carbon atoms).

Initially, toner cores 111, a dispersion of wax particles 113, and the shell layer formation liquid are mixed together to obtain the dispersion E. The toner cores 111 each have a carboxyl group (the first carboxyl group) on a surface thereof. The shell layer formation liquid contains a vinyl resin 112 for shell layer formation. The vinyl resin 112 for shell layer formation includes the constitutional unit (1-3). The wax particles 113 each have a carboxyl group (the second carboxyl group) on a surface thereof.

Next, a temperature of the dispersion E is increased to a specific temperature (for example, 70° C.) at a specific heating rate (for example, 1° C./minute) while stirring the dispersion E. Thereafter, the temperature of the dispersion E is maintained at the specific temperature for a specific time (for example, 2 hours) while stirring the dispersion E. The reaction between the first carboxyl group and the oxazoline group and the reaction between the second carboxyl group and the oxazoline group proceed while maintaining the temperature of the dispersion E at the specific temperature. More specifically, the reaction between the first carboxyl group and the oxazoline group proceeds to form a first amide bond 21. Also, the reaction between the second carboxyl group and the oxazoline group proceeds to form a second amide bond 22. The toner core 11 and the wax particle 13 are bonded together through the specific covalent bonds as described above, and the shell layer 12 (see FIG. 1) is formed. Through the above, the process for forming the shell layer has been described with reference to FIG. 3. The following returns to description of the preferable method for producing the toner according to the present embodiment, and describes the external addition process.

<2. External Addition Process>

The toner mother particles and an external additive are mixed together using a mixer (for example, an FM mixer manufactured by Nippon Coke & Engineering Co., Ltd.). Through the above, external additive particles adhere to a surface of each of the toner mother particles. Thus, a toner including a plurality of toner particles each including the toner mother particle and the external additive is obtained.

[Examples of Materials of Toner and Physical Properties]

The toner includes the plurality of toner particles. The toner particles each include the toner core, the shell layer, and the wax particles. The following describes the toner core, the shell layer, and the wax particles in order.

<Toner Core>

The toner core contains a binder resin and does not contain a wax. The toner core may further contain at least one of a colorant and a charge control agent.

(Binder Resin)

The binder resin is typically a main component (for example, at least 85% by mass) of the toner core. Therefore, properties of the binder resin are thought to have great influence on properties of the toner core as a whole.

As described above, an acid value of the binder resin is preferably at least 1 mgKOH/g and no greater than 10 mgKOH/g. More preferably, the binder resin is at least one of a polyester resin and a styrene-acrylic acid-based resin. As the polyester resin, a non-crystalline polyester resin can be used alone. Alternatively, the non-crystalline polyester resin may be used together with a crystalline polyester resin. The following mainly describes the polyester resin and the styrene-acrylic acid-based resin.

(Binder Resin: Polyester Resin)

The polyester resin is a copolymer of at least one alcohol and at least one carboxylic acid. Examples of alcohols that can be used for synthesis of the polyester resin include dihydric alcohols and tri- or higher-hydric alcohols, listed below. Examples of dihydric alcohols that can be used include diols and bisphenols. Examples of carboxylic acids that can be used for synthesis of the polyester resin include dibasic carboxylic acids and tri- or higher-basic carboxylic acids, listed below.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Examples of preferable bisphenols include bisphenol A, hydrogenated bisphenol A, bisphenol A ethylene oxide adducts, and bisphenol A propylene oxide adducts.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl- 1,2,4-butanetriol, trimethylolethane, trimethylolpropane, and 1,3,5-trihydroxymethylbenzene.

Examples of preferable dibasic carboxylic acids include aromatic dicarboxylic acids, α,ω-alkane dicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkane dicarboxylic acids include malonic acid, succinic acid, succinic anhydride, succinic acid derivatives, adipic acid, suberic acid, azelaic acid, sebacic acid, and 1,10-decanedicarboxylic acid. Examples of preferable succinic acid derivatives include alkyl succinic acids and alkenyl succinic acids. Examples of preferable alkyl succinic acids include n-butylsuccinic acid, isobutylsuccinic acid, n-octylsuccinic acid, n-dodecylsuccinic acid, and isododecylsuccinic acid. Anhydrides of the above-listed preferable alkyl succinic acids are also included in the alkyl succinic acids. Examples of preferable alkenyl succinic acids include n-butenylsuccinic acid, isobutenylsuccinic acid, n-octenylsuccinic acid, n-dodecenylsuccinic acid, and isododecenylsuccinic acid. Anhydrides of the above-listed preferable alkenyl succinic acids are also included in the alkenyl succinic acids. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Binder Resin: Crystalline Polyester Resin)

The crystalline polyester resin preferably contains an α,ω-alkanediol having a carbon number of at least 2 and no greater than 8 as an alcohol component. Preferably, the crystalline polyester resin contains two α,ω-alkanediols, for example. More specifically, the crystalline polyester resin preferably contains, as the two α,ω-alkanediols, 1,4-butanediol having a carbon number of 4 and 1,6-hexanediol having a carbon number of 6.

The crystalline polyester resin preferably contains an α,ω-alkane dicarboxylic acid having a carbon number (including the number of carbon atoms in two carboxyl groups)

of at least 4 and no greater than 10 as an acid component. Preferably, the α,ω-alkane dicarboxylic acid is a succinic acid having a carbon number of 4, for example.

More preferably, the crystalline polyester resin has a melting point (Mp) of at least 50° C. and no higher than 100° C. In the above configuration, the resultant toner has more excellent low-temperature fixability and heat-resistant preservation stability.

An amount of the crystalline polyester resin contained in the toner cores is preferably at least 1% by mass and no greater than 50% by mass relative to a total mass of the polyester resins (a sum of the mass of the crystalline polyester resin and the mass of the non-crystalline polyester resin) contained in the toner cores, and more preferably at least 5% by mass and no greater than 25% by mass. For example, when the total mass of the polyester resins contained in the toner cores is 100 g, the amount of the crystalline polyester resin contained in the toner cores is preferably at least 1 g and no greater than 50 g (more preferably, at least 5 g and no greater than 25 g). In the above configuration, the resultant toner has more excellent low-temperature fixability and heat-resistant preservation stability.

(Binder Resin: Non-Crystalline Polyester Resin)

The non-crystalline polyester resin preferably contains a bisphenol as an alcohol component. Preferably, the non-crystalline polyester resin contains at least one of a bisphenol A ethylene oxide adduct and a bisphenol A propylene oxide adduct as the bisphenol.

The non-crystalline polyester resin preferably contains at least one of an aromatic dicarboxylic acid and an unsaturated dicarboxylic acid as an acid component. The aromatic dicarboxylic acid is preferably a terephthalic acid, for example. The unsaturated dicarboxylic acid is preferably a fumaric acid, for example.

(Binder Resin: Styrene-Acrylic Acid-Based Resin)

The styrene-acrylic acid-based resin is a copolymer of at least one styrene-based monomer and at least one acrylic acid-based monomer. Styrene-based monomers listed below can be preferably used for synthesis of the styrene-acrylic acid-based resin. Also, acrylic acid-based monomers listed below can be preferably used for synthesis of the styrene-acrylic acid-based resin.

Examples of preferable styrene-based monomers include styrene, alkylstyrenes, hydroxy styrenes, and halogenated styrenes. Examples of preferable alkylstyrenes include α-methylstyrene, m-methylstyrene, p-methylstyrene, p-ethylstyrene, and 4-tert-butylstyrene. Examples of preferable hydroxystyrenes include p-hydroxystyrene and m-hydroxystyrene. Examples of preferable halogenated styrenes include α-chlorostyrene, o-chlorostyrene, m-chlorostyrene, and p-chlorostyrene.

Examples of preferable acrylic acid-based monomers include (meth)acrylic acid, (meth)acrylonitrile, (meth) acrylic acid alkyl esters, and (meth)acrylic acid hydroxyalkyl esters. Examples of preferable (meth)acrylic acid alkyl esters include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of preferable (meth)acrylic acid hydroxyalkyl esters include 2-hydroxyethyl (meth)acrylate, 3-hydroxypropyl (meth)acrylate, 2-hydroxypropyl (meth) acrylate, and 4-hydroxybutyl (meth)acrylate.

(Binder Resin: Other Resins)

Properties (specifically, a hydroxyl value, an acid value, a glass transition point, or a softening point) of the binder resin can be adjusted by using a plurality of resins in combination as the binder resin. For example, when the binder resin has an ester group, a hydroxyl group, an ether group, an acid group, or a methyl group, the toner core has a strong tendency to be anionic. When the binder resin has an amino group or an amide group, the toner core has a strong tendency to be cationic.

The binder resin preferably includes a thermoplastic resin. Examples of thermoplastic resins that can be used include styrene-based resins, acrylic acid-based resins, olefin-based resins, vinyl resins, polyamide resins, and urethane resins, in addition to the crystalline polyester resin, the non-crystalline polyester resin, and the styrene-acrylic acid-based resin. Examples of styrene-based monomers that can be used as a monomer of the styrene-based resins include the styrene-based monomers listed above in "Binder Resin: Styrene-Acrylic Acid-based Resin". Examples of acrylic acid-based monomers that can be used as a monomer of the acrylic acid-based resins include the acrylic acid-based monomers listed above in "Binder Resin: Styrene-Acrylic Acid-based Resin". Examples of olefin-based resins that can be used include polyethylene resins and polypropylene resins. Examples of vinyl resins that can be used include vinyl chloride resins, polyvinyl alcohols, vinyl ether resins, and N-vinyl resins. Also, copolymers of the above-listed resins, that is, copolymers obtained through introduction of a constitutional unit into the above-listed resins, can also be used as the thermoplastic resin that forms the toner core. For example, styrene-butadiene-based resins can also be used as the thermoplastic resin that forms the toner core.

(Colorant)

A known pigment or dye that matches the color of the toner can be used as the colorant. In order to form high-quality images using the toner, an amount of the colorant is preferably at least 1 part by mass and no greater than 20 parts by mass relative to 100 parts by mass of the binder resin.

The toner core may contain a black colorant. An example of the black colorant is carbon black. Alternatively, the black colorant may be a colorant adjusted to a black color using a yellow colorant, a magenta colorant, and a cyan colorant.

The toner core may contain a non-black colorant such as a yellow colorant, a magenta colorant, and a cyan colorant.

At least one compound selected from the group consisting of condensed azo compounds, isoindolinone compounds, anthraquinone compounds, azo metal complexes, methine compounds, and arylamide compounds can for example be used as the yellow colorant. Specific examples of yellow colorants that can be used include C. I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C. I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Specific examples of magenta colorants that can be used include C. I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

At least one compound selected from the group consisting of copper phthalocyanine compounds, anthraquinone compounds, and basic dye lake compounds can for example be used as the cyan colorant. Specific examples of cyan colorants that can be used include C. I. Pigment Blue (1, 7, 15, 15:1, 15:2, 15:3, 15:4, 60, 62, and 66), Phthalocyanine Blue, C. I. Vat Blue, and C. I. Acid Blue.

(Charge Control Agent)

The charge control agent is used in order to improve charge stability or a charge rise characteristic of the toner, for example. The charge rise characteristic of the toner is an indicator as to whether or not the toner can be charged to a specific charge level in a short period of time.

Anionicity of the toner core can be increased by including a negatively chargeable charge control agent in the toner core. Cationicity of the toner core can be increased by including a positively chargeable charge control agent in the toner core. However, the toner core need not contain the charge control agent when the toner has sufficient chargeability.

<Shell Layer>

The shell layer contains the specific vinyl resin. Preferably, the shell layer contains the specific vinyl resin and the other resin A.

(Specific Vinyl Resin)

The specific vinyl resin includes the constitutional unit (1-1), the constitutional unit (1-2), and the constitutional unit (1-3). The specific vinyl resin may further include a constitutional unit derived from a vinyl compound other than the compound represented by the formula (1-4). The vinyl compound other than the compound represented by the formula (1-4) is preferably at least one of the styrene-based monomers and the acrylic acid-based monomers listed above in "Binder Resin: Styrene-Acrylic Acid-based Resin".

(Other Resin A)

The other resin A preferably includes a positively chargeable resin and a hydrophobic resin.

(Other Resin A: Positively Chargeable Resin)

The positively chargeable resin is preferably a thermoplastic resin, and more preferably includes a constitutional unit derived from a monomer that has a positively chargeable functional group. More specifically, the positively chargeable resin is preferably a copolymer of a monomer that has a positively chargeable functional group and an acrylic acid-based monomer.

The monomer that has a positively chargeable functional group and that can be used as a monomer of the positively chargeable resin is preferably a nitrogen-containing vinyl compound, for example. Examples of preferable nitrogen-containing vinyl compounds include benzyldecylhexylmethyl ammonium salts, decyltrimethyl ammonium salts, and (meth)acryloyl group-containing quaternary ammonium salts. Examples of preferable (meth)acryloyl group-containing quaternary ammonium salts include (meth)acrylamidoalkyltrimethylammonium salts and (meth)acryloyloxyalkyltrimethylammonium salts. More specifically, examples of preferable (meth)acrylamidoalkyltrimethylammonium salts include (3-acrylamidopropyl)trimethylammonium chloride. More specifically, examples of preferable (meth)acryloyloxyalkyltrimethylammonium salts include 2-(methacryloyloxy)ethyl trimethylammonium chloride.

The acrylic acid-based monomer that can be used as a monomer of the positively chargeable resin is preferably any one of the acrylic acid-based monomers listed above in "Binder Resin: Styrene-Acrylic Acid-based Resin".

(Other Resin A: Hydrophobic Resin)

The hydrophobic resin is preferably a thermoplastic resin. More preferably, the hydrophobic resin is at least one of a styrene resin, an acrylic acid-based resin, and a styrene-acrylic acid-based resin. More specifically, at least one of a styrene-based monomer and an acrylic acid-based monomer is preferably a monomer of the hydrophobic resin. Among the styrene-based monomers listed above in "Binder Resin: Styrene-Acrylic Acid-based Resin", styrene, alkyl styrenes, and halogenated styrenes can be preferably used as the styrene-based monomer of the hydrophobic resin. Also, among the acrylic acid-based monomers listed above in "Binder Resin: Styrene-Acrylic Acid-based Resin", (meth) acrylonitrile and (meth)acrylic acid alkyl esters can be preferably used as the acrylic acid-based monomer of the hydrophobic resin. More specifically, the hydrophobic resin is preferably a copolymer of styrene and n-butyl (meth) acrylate, a copolymer of styrene, n-butyl (meth)acrylate, and hydroxyalkyl (meth)acrylate, or a copolymer of styrene, n-butyl (meth)acrylate, and acrylonitrile, for example.

<Wax Particles>

An amount of the wax particles included in the toner particles is preferably at least 1 part by mass and no greater than 30 parts by mass relative to 100 parts by mass of the toner cores. In the above configuration, the resultant toner has more excellent hot offset resistance.

The wax B may further include at least one of waxes listed below so long as the wax B includes a carnauba wax. Also, the wax B may further include at least one of the waxes listed below so long as the wax B includes both an ester wax and a behenic acid. Specifically, examples of preferable waxes that may be further included in the wax B include aliphatic hydrocarbon waxes, plant waxes, animal waxes, mineral waxes, waxes that contain a fatty acid ester as a main component, and waxes in which a fatty acid ester is partially or fully deoxidized. Examples of preferable aliphatic hydrocarbon waxes include low molecular weight polyethylene, low molecular weight polypropylene, polyolefin copolymer, polyolefin wax, microcrystalline wax, paraffin wax, and Fischer-Tropsch wax. Oxides of the above-listed preferable aliphatic hydrocarbon waxes are also included in the aliphatic hydrocarbon waxes. Examples of preferable plant waxes include candelilla wax, Japan wax, jojoba wax, and rice wax. Examples of preferable animal waxes include beeswax, lanolin, and spermaceti. Examples of preferable mineral waxes include ozokerite, ceresin, and petrolatum. Examples of preferable waxes that contain a fatty acid ester as a main component include montanic acid ester wax and castor wax.

According to the toner of the present disclosure, the wax functions as a releasing agent in the fixing process. Also, contamination by the wax can be prevented.

EXAMPLES

The following describes examples of the present disclosure. Table 1 indicates configuration of toners according to examples and comparative examples. Table 2 indicates configuration of toner cores according to the examples and the comparative examples.

TABLE 1

| | | | Shell layer formation liquid | | |
|---|---|---|---|---|---|
| | | | | Suspension | |
| Toner | Toner core | Wax suspension | Vinyl resin | Positively chargeable | Hydrophobic |
| T-1 | TC-1 | W-1 | Yes | Yes | Yes |
| T-2 | TC-1 | W-1 | Yes | Yes | Yes |
| T-3 | TC-1 | W-1 | Yes | Yes | Yes |
| T-4 | TC-1 | W-1 | Yes | Yes | Yes |
| T-5 | TC-1 | W-1 | Yes | Yes | Yes |

TABLE 1-continued

| Toner | Toner core | Wax suspension | Shell layer formation liquid: Vinyl resin | Shell layer formation liquid: Suspension: Positively chargeable | Shell layer formation liquid: Suspension: Hydrophobic |
|---|---|---|---|---|---|
| T-6 | TC-1 | W-2 | Yes | Yes | Yes |
| T-7 | TC-2 | W-1 | Yes | Yes | Yes |
| T-8 | TC-3 | W-1 | Yes | No | No |
| T-9 | TC-4 | W-1 | Yes | Yes | Yes |
| T-10 | TC-5 | — | No | Yes | Yes |
| T-11 | TC-6 | — | No | Yes | Yes |
| T-12 | TC-1 | W-3 | Yes | Yes | Yes |
| T-13 | TC-7 | W-1 | Yes | Yes | Yes |
| T-14 | TC-1 | W-1 | No | Yes | Yes |

In Table 1, "Wax suspension" indicates suspensions containing wax particles. Composition of the wax suspensions are indicated in Table 5. It is indicated in the column "Vinyl resin" whether or not an aqueous solution of an oxazoline group-containing polymer ("EPOCROS WS-300" manufactured by Nippon Shokubai Co., Ltd.) was used in "1-2. Shell Layer Formation Process" described below. "Yes" indicates that the aqueous solution of the oxazoline group-containing polymer was used, and "No" indicates that the aqueous solution of the oxazoline group-containing polymer was not used.

Also, "positively chargeable suspension" indicates a suspension containing particles of a positively chargeable resin. It is indicated in the column "Positively chargeable" whether or not the positively chargeable suspension was used in "1-2. Shell Layer Formation Process" described below. "Yes" indicates that the positively chargeable suspension was used, and "No" indicates that the positively chargeable suspension was not used.

Also, "hydrophobic suspension" indicates a suspension containing particles of a hydrophobic resin. It is indicated in the column "Hydrophobic" whether or not the hydrophobic suspension was used in "1-2. Shell Layer Formation Process" described below. "Yes" indicates that the hydrophobic suspension was used, and "No" indicates that the hydrophobic suspension was not used.

TABLE 2

| Toner core | Amount (parts by mass): Binder resin | | | | Amount (parts by mass): Wax | | Production |
|---|---|---|---|---|---|---|---|
| Type | PES-1 | PES-2 | SA-1 | SA-2 | Ester | Carnauba | method |
| TC-1 | 80.0 | 20.0 | 0.0 | 0.0 | 0.0 | 0.0 | Pulverization |
| TC-2 | 0.0 | 0.0 | 100.0 | 0.0 | 0.0 | 0.0 | Pulverization |
| TC-3 | 90.0 | 10.0 | 0.0 | 0.0 | 0.0 | 0.0 | Pulverization |
| TC-4 | 80.0 | 20.0 | 0.0 | 0.0 | 0.0 | 0.0 | Aggregation in liquid |
| TC-5 | 80.0 | 20.0 | 0.0 | 0.0 | 2.5 | 2.5 | Pulverization |
| TC-6 | 80.0 | 20.0 | 0.0 | 0.0 | 1.0 | 1.0 | Pulverization |
| TC-7 | 0.0 | 0.0 | 0.0 | 100.0 | 0.0 | 0.0 | Pulverization |

In Table 2, "PES-1", "PES-2", "SA-1", and "SA-2" indicate respective resins indicated in Table 3. "Ester" and "Carnauba" indicate respective waxes indicated in Table 4.

TABLE 3

| | Material (Binder resin) | Acid value (mgKOH/g) |
|---|---|---|
| PES-1 | Non-crystalline polyester resin | 6.0 |
| PES-2 | Crystalline polyester resin | 3.1 |
| SA-1 | Styrene-acrylic acid-based resin | 7.2 |
| SA-2 | Styrene-acrylic acid-based resin | 0.0 |

TABLE 4

| | Material | Acid value (mgKOH/g) | Melting temperature (° C.) |
|---|---|---|---|
| Ester | "NISSAN ELECTOL WEP-3" manufactured by NOF Corporation | 0.1 | 73 |
| Carnauba | "Carnauba Wax No. 1" manufactured by S. Kato & Co. | 10 | 88 |
| Behenic acid | "NAA-222S" manufactured by NOF Corporation | 165 | 74-78 |

TABLE 5

| Wax suspension | Amount of wax particles (parts by mass): Ester | Carnauba | Behenic acid | Acid value | Volume median diameter |
|---|---|---|---|---|---|
| Type | | | | (mgKOH/g) | (nm) |
| W-1 | 20.0 | 20.0 | 0.0 | 1.5 | 50 |
| W-2 | 38.8 | 0.0 | 1.2 | 5.0 | 63 |
| W-3 | 40.0 | 0.0 | 0.0 | 0.1 | 70 |

In Table 5, "Ester", "Carnauba", and "Behenic acid" indicate the respective waxes indicated in Table 4. "Acid value" indicates acid values of the wax particles contained in the respective wax suspensions. "Volume median diameter" indicates volume median diameters ($D_{50}$) of the wax particles contained in the respective wax suspensions.

The following describes, in order, production methods, evaluation methods, and evaluation results for toners (electrostatic latent image developing toners) according to the examples and the comparative examples. In evaluations in which errors may occur, an evaluation value was calculated by calculating an arithmetic mean of an appropriate number of measured values to ensure that any errors were sufficiently small.

[Method for Synthesizing Binder Resin]

(Method for Synthesizing Non-Crystalline Polyester Resin PES-1)

A four-necked flask (capacity: 5 L) equipped with a thermometer (more specifically, a thermocouple), a dewatering conduit, a nitrogen inlet tube, and a stirring device was charged with 1,700 g of a bisphenol A propylene oxide adduct, 650 g of a bisphenol A ethylene oxide adduct, 500 g of n-dodecenyl succinic anhydride, 400 g of terephthalic acid, and 4 g of dibutyl tin oxide. A temperature inside the flask was increased to 220° C. Reaction of the flask contents was caused for 9 hours while maintaining the temperature inside the flask at 220° C. A pressure inside the flask was lowered to 8 kPa. Reaction of the flask contents was further caused for 5 hours at the high temperature (220° C.) and the low pressure (8 kPa). Through the above, a non-crystalline polyester resin PES-1 was obtained. The non-crystalline polyester resin PES-1 had a softening point (Tm) of 124.8°

C., a glass transition point (Tg) of 57.2° C., an acid value of 6.0 mgKOH/g, a hydroxyl value of 41 mgKOH/g, a number average molecular weight (Mn) of 3,737 and a mass average molecular weight (Mw) of 109,475.

(Method for Synthesizing Crystalline Polyester Resin PES-2)

A four-necked flask (capacity: 5 L) equipped with a thermometer (more specifically, a thermocouple), a dewatering conduit, a nitrogen inlet tube, and a stirring device was charged with 990.0 g (84 parts by mole) of 1,4-butanediol, 242.0 g (11 parts by mole) of 1,6-hexanediol, 1,480.0 g (100 parts by mole) of fumaric acid, and 2.5 g of 1,4-benzenediol. A temperature inside the flask was increased to 170° C. Reaction of the flask contents was caused for 5 hours while maintaining the temperature inside the flask at 170° C. The temperature inside the flask was increased to 210° C. Reaction of the flask contents was caused for 1.5 hours while maintaining the temperature inside the flask at 210° C. A pressure inside the flask was lowered to 8 kPa. Reaction of the flask contents was further caused for 1 hour at the high temperature (210° C.) and the low pressure (8 kPa).

The pressure inside the flask was restored to normal pressure. Then, 69.0 g (2.8 parts by mole) of styrene and 54.0 g (2.2 parts by mole) of n-butyl methacrylate were added into the flask. Reaction of the flask contents was caused for 1.5 hours while maintaining the temperature inside the flask at 210° C. The pressure inside the flask was lowered to 8 kPa. Reaction of the flask contents was further caused for 1 hour at the high temperature (210° C.) and the low pressure (8 kPa). Through the above, a crystalline polyester resin PES-2 was obtained. The crystalline polyester resin PES-2 had Tm of 88.8° C., Mp of 82° C., an acid value of 3.1 mgKOH/g, a hydroxyl value of 19 mgKOH/g, Mn of 3,620 and Mw of 27,500.

(Method for Synthesizing Styrene-Acrylic Acid-Based Resin SA-1)

A four-necked flask (capacity: 5 L) equipped with a thermometer (more specifically, a thermocouple), a dewatering conduit, a nitrogen inlet tube, and a stirring device was charged with 2 L of ion exchanged water and 60 g of tricalcium phosphate (product of TAIHEI CHEMICAL INDUSTRIAL CO., LTD.). Then, 700.0 g of styrene, 270.0 g of n-butyl acrylate, 4.5 g of divinylbenzene, 30.0 g of acrylic acid, and a liquid constituting an oil phase were added into the flask while stirring the flask contents at a rotational speed of 50 rpm. In the liquid constituting the oil phase, 15.0 g of 2,2'-azobis(2,4-dimethylvaleronitrile) was dissolved in 25.0 g of diethylene glycol. A temperature inside the flask was increased to 80° C. Polymerization reaction of the flask contents was caused for 8 hours while maintaining the temperature inside the flask at 80° C. Through the above, a styrene-acrylic acid-based resin SA-1 in the form of beads was obtained. The styrene-acrylic acid-based resin SA-1 had Tm of 102.3° C., Tg of 40.3° C., an acid value of 7.2 mgKOH/g, Mn of 2,680, and Mw of 131,026.

(Method for Synthesizing Styrene-Acrylic Acid-Based Resin SA-2)

A four-necked flask (capacity: 5 L) equipped with a thermometer (more specifically, a thermocouple), a dewatering conduit, a nitrogen inlet tube, and a stirring device was charged with 2 L of ion exchanged water and 60 g of tricalcium phosphate (product of TAIHEI CHEMICAL INDUSTRIAL CO., LTD.). Then, 730.0 g of styrene, 270.0 g of n-butyl acrylate, 4.5 g of divinylbenzene, and a liquid constituting an oil phase were added into the flask while stirring the flask contents at a rotational speed of 50 rpm. In the liquid constituting the oil phase, 15.0 g of 2,2'-azobis (2,4-dimethylvaleronitrile) was dissolved in 25.0 g of diethylene glycol. A temperature inside the flask was increased to 80° C. Polymerization reaction of the flask contents was caused for 8 hours while maintaining the temperature inside the flask at 80° C. Through the above, a styrene-acrylic acid-based resin SA-2 in the form of beads was obtained. The styrene-acrylic acid-based resin SA-2 had Tm of 110.3° C., Tg of 41.5° C., an acid value of 0.0 mgKOH/g, Mn of 2,740, and Mw of 120,263.

[Method for Measuring Acid Value of Binder Resin]

The acid value of each binder resin was measured in accordance with JIS K0070-1992.

Specifically, 20 g of the binder resin (measurement sample) was placed in a conical flask. Then, 100 mL of a solvent and a few drops of a phenolphthalein solution (indicator) were added into the conical flask. In measurement of the acid values of the non-crystalline polyester resin PES-1 and the crystalline polyester resin PES-2, a liquid mixture of acetone and toluene (acetone:toluene=1:1 (volume ratio)) was used as the solvent. In measurement of the acid values of the styrene-acrylic acid-based resins SA-1 and SA-2, a liquid mixture of diethyl ether and ethanol (diethyl ether:ethanol=2:1 (volume ratio)) was used as the solvent.

The measurement sample was dissolved in the solvent by shaking the conical flask in a water bath. The liquid in the conical flask was titrated using a 0.1 mol/L potassium hydroxide-ethanol solution. The acid value (unit: mgKOH/g) was calculated from a result of the titration in accordance with the following numerical expression (expression 1).

$$\text{Acid value}=(B\times f1\times 5.611)/W1 \quad \text{(expression 1)}$$

In the above numerical expression (expression 1), "B" represents an amount (mL) of the 0.1 mol/L potassium hydroxide-ethanol solution used in the titration. Also, "f1" represents a factor for the 0.1 mol/L potassium hydroxide-ethanol solution. Also, "W1" represents the mass (g) of the measurement sample. Also, "5.611" corresponds to the formula weight "56.11×(1/10)" of potassium hydroxide.

Note that the factor (f1) was calculated by the following method. First, 25 mL of 0.1 mol/L hydrochloric acid was placed in a conical flask. Then, the phenolphthalein solution was added into the conical flask. The liquid in the conical flask was titrated using the 0.1 mol/L potassium hydroxide-ethanol solution. The factor (f1) was calculated from an amount of the 0.1 mol/L potassium hydroxide-ethanol solution required for neutralization.

[Method for Preparing Wax Suspension]

(Method for Preparing Wax Suspension W-1)

A stirring device equipped with a stirring impeller was charged with 20.0 parts by mass of an ester wax ("NISSAN ELECTOL WEP-3" manufactured by NOF Corporation), 20.0 parts by mass of a carnauba wax ("Carnauba Wax No. 1" manufactured by S. Kato & Co.), 0.5 parts by mass of sodium dodecylbenzenesulfonate (anionic surfactant), and 59.5 parts by mass of ion exchanged water. A temperature inside the stirring device was increased to 90° C. while stirring the contents within the stirring device at a rotational speed of 9,500 rpm. Emulsification of the contents within the stirring device was performed for 5 minutes using a homogenizer ("ULTRA-TURRAX T50" manufactured by IKA Works) while maintaining the temperature inside the stirring device at 90° C. Emulsification of the contents within the stirring device was further performed using a Gaulin homogenizer ("APV homogenizer model 15M-8TA" manufactured by SPX Corporation) while maintaining the temperature inside the stirring device at 90° C. Through the above, a wax suspension W-1 was obtained.

(Method for Preparing Wax Suspension W-2)

A stirring device equipped with a stirring impeller was charged with 38.8 parts by mass of an ester wax ("NISSAN ELECTOL WEP-3" manufactured by NOF Corporation), 1.2 parts by mass of behenic acid ("NAA-222S" manufactured by NOF Corporation), 0.5 parts by mass of sodium dodecylbenzenesulfonate, and 59.5 parts by mass of ion exchanged water. A wax suspension W-2 was obtained by the same procedure as the preparation of the wax suspension W-1.

(Method for Preparing Wax Suspension W-3)

A stirring device equipped with a stirring impeller was charged with 40.0 parts by mass of an ester wax ("NISSAN ELECTOL WEP-3" manufactured by NOF Corporation), 0.5 parts by mass of sodium dodecylbenzenesulfonate, and 59.5 parts by mass of ion exchanged water. A wax suspension W-3 was obtained by the same procedure as the preparation of the wax suspension W-1.

[Methods for Measuring Physical Properties of Wax Particles Contained in Wax Suspension]

An acid value of wax particles contained in each of the wax suspensions W-1 to W-3 was measured by the method described above in "Method for Measuring Acid Value of Binder Resin". Results of the measurement are indicated in Table 5. Also, a volume median diameter ($D_{50}$) of the wax particles contained in each of the wax suspensions W-1 to W-3 was measured using a laser diffraction/scattering particle size distribution analyzer ("LA-950V2" manufactured by HORIBA, Ltd.). Results of the measurement are indicated in Table 5.

Note that the wax particles contained in each of the wax suspensions W-1 to W-3 had sharp particle size distribution. Specifically, the wax particles contained in the wax suspension W-1 substantially included only wax particles each having a particle diameter of approximately 50 nm. The wax particles contained in the wax suspension W-2 substantially included only wax particles each having a particle diameter of approximately 63 nm. The wax particles contained in the wax suspension W-3 substantially included only wax particles each having a particle diameter of approximately 70 nm.

[Method for Preparing Positively Chargeable Suspension]

A three-necked flask (capacity: 1 L) equipped with a thermometer (more specifically, a thermocouple), a cooling tube, a nitrogen inlet tube, and a stirring impeller was charged with 90 g of isobutanol, 100 g of methyl methacrylate, 35 g of n-butyl acrylate, 30 g of 2-(methacryloyloxy) ethyl trimethylammonium chloride (product of Alfa Aesar), and 6 g of a water-soluble azo polymerization initiator ("VA-086" manufactured by Wako Pure Chemical Industries, Ltd.). A temperature inside the flask was increased to 80° C. Reaction of the flask contents was caused by stirring the flask contents at a rotational speed of 75 rpm for 3 hours in a nitrogen atmosphere while maintaining the temperature inside the flask at 80° C.

Further, 3 g of the water-soluble azo polymerization initiator ("VA-086" manufactured by Wako Pure Chemical Industries, Ltd.) was added into the flask. Reaction of the flask contents was caused for 3 hours in the nitrogen atmosphere while maintaining the temperature inside the flask at 80° C. The temperature inside the flask was increased to 150° C. and a pressure inside the flask was lowered to normal pressure to dry the flask contents. A resin X was obtained by breaking up the resultant solid.

A mixer ("HIVIS MIX (registered Japanese trademark) model 2P-1" manufactured by PRIMIX Corporation) was charged with 200 g of the resin X and 184 mL of ethyl acetate ("ethyl acetate JIS special grade" manufactured by Wako Pure Chemical Industries, Ltd.). The contents within the mixer were stirred for 1 hour at a rotational speed of 20 rpm. Then, 18 mL of hydrochloric acid (concentration: 1 N) and a first liquid were added to the resultant solution. In the first liquid, 20 g of an anionic surfactant ("EMAL (registered Japanese trademark) 0" manufactured by Kao Corporation) and 16 g of ethyl acetate ("ethyl acetate JIS special grade" manufactured by Wako Pure Chemical Industries, Ltd.) were dissolved in 562 g of ion exchanged water. Through the above, a positively chargeable suspension was obtained.

A volume median diameter ($D_{50}$) of resin particles P1 contained in the positively chargeable suspension was measured using a laser diffraction/scattering particle size distribution analyzer ("LA-950V2" manufactured by HORIBA, Ltd.). The volume median diameter ($D_{50}$) of the resin particles P1 was 35 nm. The resin particles P1 had sharp particle size distribution, and substantially included only resin particles each having a particle diameter of approximately 35 nm. Also, a glass transition point of the resin particles P1 contained in the positively chargeable suspension was measured using a differential scanning calorimeter ("DSC-6220" manufactured by Seiko Instruments Inc.). The glass transition point of the resin particles P1 was 80° C.

[Method for Preparing Hydrophobic Suspension]

A three-necked flask (capacity: 1 L) equipped with a thermometer and a stirring impeller was charged with 875 mL of ion exchanged water and 75 mL of an anionic surfactant ("LATEMUL (registered Japanese trademark) WX" manufactured by Kao Corporation, component: polyoxyethylene alkyl ether sodium sulfate, solid concentration: 26% by mass). The flask was set in a water bath, and then a temperature inside the flask was maintained at 80° C. using the water bath. A second liquid and a third liquid were dripped into the flask over 5 hours while maintaining the temperature inside the flask at 80° C. and stirring the flask contents at a rotational speed of 75 rpm. The second liquid was constituted by 18 mL of styrene and 2 mL of n-butyl acrylate. In the third liquid, 0.5 g of potassium peroxodisulfate was dissolved in 30 mL of ion exchanged water. Reaction (polymerization reaction) of the flask contents was caused by stirring the flask contents at a rotational speed of 75 rpm for 2 hours while maintaining the temperature inside the flask at 80° C. Through the above, a hydrophobic suspension was obtained.

A volume median diameter ($D_{50}$) of resin particles P2 contained in the hydrophobic suspension was measured using a laser diffraction/scattering particle size distribution analyzer ("LA-950V2" manufactured by HORIBA, Ltd.). The volume median diameter ($D_{50}$) of the resin particles P2 was 32 nm. The resin particles P2 had sharp particle size distribution, and substantially included only resin particles each having a particle diameter of approximately 32 nm. Also, a glass transition point of the resin particles P2 contained in the hydrophobic suspension was measured using a differential scanning calorimeter ("DSC-6220" manufactured by Seiko Instruments Inc.). The glass transition point of the resin particles P2 was 71° C.

[Method for Producing Toner]

<Method for Producing Toner T-1>

First, a toner mother particle production process was performed. Then, an external addition process was performed.

(1. Toner Mother Particle Production Process)

(1-1. Toner Core Production Process)

First, 80.0 parts by mass of the non-crystalline polyester resin PES-1, 20.0 parts by mass of the crystalline polyester resin PES-2, and 6.0 parts by mass of carbon black ("MA100" manufactured by Mitsubishi Chemical Corporation) were mixed using an FM mixer ("FM-20B" manufactured by Nippon Coke & Engineering Co., Ltd.).

The resultant mixture was melt-kneaded using a twin-screw extruder ("PCM-30" manufactured by Ikegai Corp.) under conditions of a material feeding speed of 6 kg/hour, a shaft rotational speed of 160 rpm, and a set temperature (cylinder temperature) of 120° C. The resultant melt-kneaded product was cooled. The cooled melt-kneaded product was coarsely pulverized using a pulverizer ("ROTOPLEX (registered Japanese trademark)" manufactured by Hosokawa Micron Corporation). The resultant coarsely pulverized product was finely pulverized using a pulverizer ("Turbo Mill Type RS" manufactured by FREUND-TURBO CORPORATION). The resultant finely pulverized product was classified using a classifier ("Elbow Jet Type EJ-LABO" manufactured by Nittetsu Mining Co., Ltd.). Through the above, toner cores TC-1 having a volume median diameter ($D_{50}$) of 7 μm were obtained.

(1-2. Shell Layer Formation Process)

Next, a shell layer was formed. Specifically, a three-necked flask (capacity: 1 L) equipped with a thermometer and a stirring impeller was charged with 300 mL of ion exchanged water, and set in a water bath. A temperature inside the flask was maintained at 30° C. using the water bath. Then, 3.0 g of an aqueous solution of an oxazoline group-containing polymer ("EPOCROS WS-300" manufactured by Nippon Shokubai Co., Ltd., solid concentration: 10% by mass, Tg: 90° C.), 2.0 mL of the wax suspension W-1, 220.0 mL of the hydrophobic suspension, and 1.2 mL of the positively chargeable suspension were added into the flask. Further, 300.0 g of the toner cores TC-1 and 6 mL of ammonia water (concentration: 1% by mass) were added into the flask. Here, the amount of the aqueous solution of the oxazoline group-containing polymer was adjusted such that a solid content (more specifically, an amount of the vinyl resin for shell layer formation) in the aqueous solution of the oxazoline group-containing polymer was 0.10 parts by mass relative to 100.0 parts by mass of the toner cores. Also, the amount of the wax suspension W-1 was adjusted such that a solid content (more specifically, an amount of the wax particles) in the wax suspension W-1 was 0.27 parts by mass relative to 100.0 parts by mass of the toner cores.

The temperature inside the flask was increased to 70° C. at a heating rate of 1° C./minute while stirring the flask contents at a rotational speed of 100 rpm. The flask contents were stirred for 2 hours at the rotational speed of 100 rpm while maintaining the temperature inside the flask at 70° C. Then, the temperature inside the flask was cooled to normal temperature. Through the above, a toner mother particle-containing dispersion was obtained.

(1-3. Washing Process)

Vacuum filtration of the resultant dispersion was performed using a Buchner funnel. The resultant wet cake of toner mother particles was re-dispersed in ion exchanged water. Vacuum filtration of the resultant dispersion was performed using a Buchner funnel. Solid-liquid separation as described above was repeated five times.

(1-4. Drying Process)

The resultant toner mother particles were dispersed in a 50% by mass aqueous ethanol solution. Through the above, slurry of the toner mother particles was obtained. The toner mother particles in the slurry were then dried using a continuous surface-modifying apparatus ("COATMIZER (registered Japanese trademark)" manufactured by Freund Corporation) under conditions of a hot air temperature of 45° C. and a blower flow rate of 2 $m^3$/minute. Mechanical treatment (more specifically, treatment for applying shear force) was performed on the toner mother particles using a closed-type flow mixer ("FM-20C/I" manufactured by Nippon Coke & Engineering Co., Ltd.) under conditions of a rotational speed of 3,000 rpm, a jacket temperature of 20° C., and a treatment time of 10 minutes. Through the above, the toner mother particles were obtained.

(2. External Addition Process)

An FM mixer ("FM-10B" manufactured by Nippon Coke & Engineering Co., Ltd.) was charged with 100.0 parts by mass of the toner mother particles, 1.2 parts by mass of hydrophobic silica particles ("AEROSIL (registered Japanese trademark) RA-200H" manufactured by Nippon Aerosil Co., Ltd.), and 0.8 parts by mass of electrically conductive titanium oxide particles ("EC-100" manufactured by Titan Kogyo, Ltd.). The toner mother particles, the hydrophobic silica particles, and the electrically conductive titanium oxide particles were mixed under conditions of a rotational speed of 3,000 rpm, a jacket temperature of 20° C., and a treatment time of 2 minutes. Through the above, a toner T-1 including a large number of toner particles was obtained.

<Methods for Producing Toners T-2 and T-3>

Toners T-2 and T-3 were produced by the same procedure as the production of the toner T-1 in all aspects other than that the amount of the wax suspension W-1 used in "1-2. Shell Layer Formation Process" described above was changed.

More specifically, in production of the toner T-2, the amount of the wax suspension W-1 was adjusted such that a solid content (more specifically, an amount of the wax particles) in the wax suspension W-1 was 0.03 parts by mass relative to 100.0 parts by mass of the toner cores. Further specifically, in the production of the toner T-2, 0.20 mL of the wax suspension W-1 was used. Also, in production of the toner T-3, the amount of the wax suspension W-1 was adjusted such that a solid content (more specifically, an amount of the wax particles) in the wax suspension W-1 was 0.67 parts by mass relative to 100.0 parts by mass of the toner cores. Further specifically, in the production of the toner T-3, 5.00 mL of the wax suspension W-1 was used.

<Methods for Producing Toners T-4 and T-5>

Toners T-4 and T-5 were produced by the same procedure as the production of the toner T-1 in all aspects other than that the amount of the aqueous solution of the oxazoline group-containing polymer used in "1-2. Shell Layer Formation Process" described above was changed.

More specifically, in production of the toner T-4, 0.3 g of the aqueous solution of the oxazoline group-containing polymer was used. That is, the amount of the aqueous solution of the oxazoline group-containing polymer was adjusted such that a solid content (more specifically, an amount of the vinyl resin for shell layer formation) in the aqueous solution of the oxazoline group-containing polymer was 0.01 parts by mass relative to 100.0 parts by mass of the toner cores.

Also, in production of the toner T-5, 10.0 g of the aqueous solution of the oxazoline group-containing polymer was used. That is, the amount of the aqueous solution of the oxazoline group-containing polymer was adjusted such that a solid content (more specifically, an amount of the vinyl resin for shell layer formation) in the aqueous solution of the oxazoline group-containing polymer was 0.33 parts by mass relative to 100.0 parts by mass of the toner cores.

<Method for Producing Toner T-6>

In "1-2. Shell Layer Formation Process" described above, the wax suspension W-2 was used instead of the wax suspension W-1. Except the above, the toner T-6 was produced by the same procedure as the production of the toner T-1.

<Method for Producing Toner T-7>

Toner cores TC-2 were produced using 100.0 parts by mass of the styrene-acrylic acid-based resin SA-1 as the binder resin. The toner cores TC-2 were used in production of a toner T-7. Except the above, the toner T-7 was produced by the same procedure as the production of the toner T-1.

<Method for Producing Toner T-8>

Toner cores TC-3 were produced by changing the amount of the non-crystalline polyester resin PES-1 to 90.0 parts by mass, and changing the amount of the crystalline polyester resin PES-2 to 10.0 parts by mass. The toner cores TC-3 were used in production of a toner T-8. Except the above, the toner T-8 was produced by the same procedure as the production of the toner T-1.

<Method for Producing Toner T-9>

A toner T-9 was produced by the same procedure as the production of the toner T-1 in all aspects other than that toner cores TC-4 produced by aggregation in a liquid were used.

The toner cores TC-4 were produced by the following method.

First, a dispersion (hereinafter referred to as a "dispersion X") of particles containing a binder resin was prepared. Specifically, 80.0 parts by mass of the non-crystalline polyester resin PES-1 and 20.0 parts by mass of the crystalline polyester resin PES-2 were mixed using an FM mixer ("FM-20B" manufactured by Nippon Coke & Engineering Co., Ltd.). The resultant mixture was coarsely pulverized using a mechanical pulverizer ("Turbo Mill T250" manufactured by FREUND-TURBO CORPORATION). Then, 100.0 parts by mass of the coarsely pulverized product, 2.0 parts by mass of an anionic surfactant ("EMAL E-27C" manufactured by Kao Corporation), and 50.0 parts by mass of a sodium hydroxide aqueous solution (concentration: 0.1 N) were mixed. Further, ion exchanged water was added to the resultant mixture to obtain 500.0 parts by mass of a slurry.

The resultant slurry was placed in a pressure-proof stainless steel container (having a round bottom), and the pressure-proof stainless steel container was set in a high-speed shear emulsification device ("CLEARMIX (registered Japanese trademark) CLM-2.2S" manufactured by M Technique Co., Ltd.). Shear dispersion of the contents in the pressure-proof stainless steel container was performed using the high-speed shear emulsification device for 30 minutes at a high temperature (145° C.) and a high pressure (0.5 MPa) (at a rotor rational speed of 20,000 rpm). The temperature inside the pressure-proof stainless steel container was lowered to 50° C. at a cooling rate of 5° C./minute while stirring the contents in the pressure-proof stainless steel container at a changed rotor rotational speed of 15,000 rpm. After stopping stirring of the contents in the pressure-proof stainless steel container, the temperature inside the pressure-proof stainless steel container was lowered to normal temperature at a cooling rate of 5° C./minute.

Ion exchanged water was added to the slurry. Through the above, the dispersion X having a solid concentration of 5% by mass was obtained. A volume median diameter ($D_{50}$) of resin particles contained in the dispersion X was measured using a particle size distribution analyzer ("MICROTRAC (registered Japanese trademark) UPA150" manufactured by MicrotracBEL Corp.). The volume median diameter ($D_{50}$) of the resin particles was 120 nm.

Next, a dispersion (hereinafter referred to as a "dispersion Y") of particles containing a colorant was prepared. Specifically, 95.0 parts by mass of carbon black ("MA100" manufactured by Mitsubishi Chemical Corporation), 5.0 parts by mass of an anionic surfactant (more specifically, sodium dodecyl sulfate), and 400.0 parts by mass of ion exchanged water were mixed. Emulsification and dispersion of the resultant liquid mixture were performed using a high-pressure impact type dispersing machine Star Burst ("HJP30006" manufactured by Sugino Machine Limited) for 1 hour. Through the above, the dispersion Y having a solid concentration of 19% by mass was obtained.

Subsequently, the toner cores TC-4 were produced using the dispersions X and Y. Specifically, a four-necked flask (capacity: 1 L) equipped with a thermometer (more specifically, a thermocouple), a cooling tube, and a stirring device was charged with 437.5 parts by mass of the dispersion X, 7.0 parts by mass of the dispersion Y, 12.0 parts by mass of an anionic surfactant ("EMAL 0" manufactured by Kao Corporation), and 43.5 parts by mass of ion exchanged water. The flask contents were stirred for 5 minutes at a rotational speed of 200 rpm. Triethanolamine was added into the flask to adjust pH of the flask contents to 10. A magnesium chloride aqueous solution was added into the flask. In the magnesium chloride aqueous solution, 10.2 parts by mass of magnesium chloride hexahydrate was dissolved in 10.2 parts by mass of ion exchanged water. Thereafter, the flask was left to stand for 5 minutes.

A temperature inside the flask was increased to 50° C. at a heating rate of 5° C./minute. Then, the temperature inside the flask was increased to 73° C. at a heating rate of 0.5° C./minute while stirring the flask contents at a rotational speed of 75 rpm. Solids in the flask contents were caused to aggregate while maintaining the temperature inside the flask at 73° C. Once a volume median diameter ($D_{50}$) of the resultant aggregated included in the flask contents reached 6.5 μm, the flask contents were stirred for 10 minutes at a rotational speed of 350 rpm. The temperature inside the flask was lowered from 73° C. to normal temperature at a cooling rate of 5° C./minute. Through the above, a dispersion of the toner cores TC-4 was obtained. The dispersion of the toner cores TC-4 was filtered using a Buchner funnel. Through the above, the toner cores TC-4 (in the form of a wet cake) having a solid concentration of 83% were obtained. Note that in "1-2. Shell Layer Formation Process" subsequently performed, 300.0 parts by mass of the toner cores TC-4 (in the form of a wet cake) were used instead of 300.0 parts by mass of the toner cores TC-1.

<Method for Producing Toner T-10>

In "1-1. Toner Core Production Process" described above, 80.0 parts by mass of the non-crystalline polyester resin PES-1, 20.0 parts by mass of the crystalline polyester resin PES-2, 6.0 parts by mass of carbon black, 2.5 parts by mass of an ester wax ("NISSAN ELECTOL WEP-3" manufactured by NOF Corporation), and 2.5 parts by mass of a carnauba wax ("Carnauba Wax No. 1" manufactured by S. Kato & Co.) were mixed using an FM mixer ("FM-20B" manufactured by Nippon Coke & Engineering Co., Ltd.) (toner cores TC-5). Also, in "1-2. Shell Layer Formation Process" described above, the aqueous solution of the oxazoline group-containing polymer and the wax suspension were not used. Except the above, the toner T-10 was produced by the same procedure as the production of the toner T-1.

<Method for Producing Toner T-11>

Toner cores TC-6 were produced by changing each of the amounts of the ester wax and the carnauba wax to 1.0 part by mass. The toner cores TC-6 were used in production of a toner T-11. Except the above, the toner T-11 was produced by the same procedure as the production of the toner T-10.

<Method for Producing Toner T-12>

In "1-2. Shell Layer Formation Process" described above, the wax suspension W-3 was used instead of the wax suspension W-1. Except the above, a toner T-12 was produced by the same procedure as the production of the toner T-1.

<Method for Producing Toner T-13>

Toner cores TC-7 were produced using 100.0 parts by mass of the styrene-acrylic acid-based resin SA-2 as the binder resin. The toner cores TC-7 were used in production of a toner T-13. Except the above, the toner T-13 was produced by the same procedure as the production of the toner T-1.

<Method for Producing Toner T-14>

A toner T-14 was produced by the same procedure as the production of the toner T-1 in all aspects other than that the aqueous solution of the oxazoline group-containing polymer was not used in "1-2. Shell Layer Formation Process" described above.

[Methods for Measuring Physical Properties of Toner]

An acid value of a binder resin contained in toner particles and an acid value of wax particles included in the toner particles were measured by a method described below. Also, a thickness of the shell layer was measured. In measurement of these physical properties, toner particles from which an external additive had been removed (that is, toner mother particles) were used as a sample.

<Method for Measuring Acid Value>

First, 4 kg of the toner mother particles was dispersed in 18 L of hexane. A wax component derived from the wax particles was extracted into hexane, but a resin component derived from the binder resin was not extracted into hexane. The resultant dispersion was filtered using a Buchner funnel. Through the filtration, the dispersion was separated into the component (wax component) extracted into hexane and the component (resin component) that was not extracted into hexane.

The component (the resin component) that was not extracted into hexane was dried. An acid value of the binder resin contained in the toner particles was measured using the resultant powder by a method described above in "Method for Measuring Acid Value of Binder Resin". Results of the measurement are indicated in Table 6.

Hexane was removed from the component extracted into hexane using an evaporator. Through the above, approximately 20 g of a powder (the wax component) was obtained. An acid value of the wax particles included in the toner particles was measured using the resultant powder by the method described above in "Method for Measuring Acid Value of Binder Resin". Results of the measurement are indicated in Table 6.

<Method for Measuring Thickness of Shell Layer>

First, a cross-sectional TEM photograph of the toner mother particles was taken using a transmission electron microscope ("H-7100FA" manufactured by Hitachi High-Technologies Corporation). Next, the cross-sectional TEM photograph of the toner mother particles was analyzed using image analysis software ("WinROOF" manufactured by Mitani Corporation). Specifically, two straight lines intersecting perpendicularly with each other substantially at the center of a cross section of a toner mother particle were drawn. A length of each portion of the two straight lines extending from a boundary (i.e., a surface of a toner core) between the toner core and the shell layer to a surface (more specifically, a surface of the peripheral portion) of the shell layer was measured. A mean value of the thus measured four lengths was determined as the thickness of the shell layer of the toner mother particle. The measurement of the thickness of the shell layer as described above was performed for a plurality of toner mother particles, and a mean value of the thus measured thicknesses of the shell layers of the respective toner mother particles (measurement targets) was obtained. The thus obtained mean value of the thicknesses of the shell layers was determined as the "thickness of the shell layer". Results are indicated in Table 6.

When the boundary between the toner core and the shell layer was unclear in the cross-sectional TEM photograph of the toner mother particles, the cross-sectional TEM photograph of the toner mother particles was analyzed using an electron energy loss spectroscopy (EELS) detector ("GIF TRIDIEM (registered Japanese trademark)" manufactured by Gatan, Inc.) and image analysis software ("WinROOF" manufactured by Mitani Corporation).

[Method for Evaluating Toner]

Presence of the specific covalent bonds was confirmed by a method described below. Results are indicated in Table 6. Also, low-temperature fixability of the toner, hot offset resistance of the toner, and existence of contamination by wax were evaluated. Results are indicated in Table 7.

<Method for Confirming Presence of Specific Covalent Bonds>

First, 20 mg of toner mother particles (sample) was dissolved in 1 mL of deuterated chloroform. The resultant solution was placed in a test tube (diameter: 5 mm). The test tube was set in a Fourier transform nuclear magnetic resonance apparatus (FT-NMR) ("JNM-AL400" manufactured by JEOL Ltd.). A $^{1}$H-NMR spectrum was measured under conditions of a temperature of the sample of 20° C. and the number of accumulation of 128 times. Tetramethylsilane was used as an internal standard substance of a chemical shift. When a triplet signal was observed around a chemical shift δ of 6.5 in the obtained $^{1}$H-NMR spectrum, it was presumed that the specific covalent bonds were present. That is, when a triplet signal was observed around a chemical shift δ of 6.5, it was presumed that the amide bond (the first amide bond) included in the constitutional unit (1-1) and the amide bond (the second amide bond) included in the constitutional unit (1-2) were present. Further, when a triplet signal was observed around a chemical shift δ of 6.5, it was presumed that the constitutional units (1-1) and (1-2) were included in the vinyl resin. Note that when the aqueous solution of the oxazoline group-containing polymer was used in "1-2. Shell Layer Formation Process" described above (that is, when "Vinyl resin" in Table 6 shown further below is "Yes"), the constitutional unit (1-3) was included in the vinyl resin.

<Method for Evaluating Low-Temperature Fixability of Toner>

(Method for Preparing Evaluation Target)

The toner (each of the toners T-1 to T-14) and a carrier (a carrier for "TASKalfa5550ci" manufactured by KYOCERA Document Solutions Inc.) were loaded into a ball mill such that an amount of the toner was 10% by mass, and mixed for 30 minutes. Through the above, an evaluation target was obtained.

(Method for Preparing Evaluation Apparatus)

A printer ("FS-C5250DN" manufactured by KYOCERA Document Solutions Inc.) modified to enable adjustment of fixing temperature was used as an evaluation apparatus. The evaluation target (unused) was loaded into a developing device for black color of the evaluation apparatus, and the toner (unused) for replenishment use was loaded into a toner container for black color of the evaluation apparatus. In the examples, the toner for replenishment use was the same as the toner included in the evaluation target. The evaluation apparatus was prepared as described above.

(Measurement of Minimum Fixing Temperature: Preliminary Test)

In measurement of the minimum fixing temperature, an evaluation test was performed after a preliminary test was performed. In the preliminary test, a temperature range in which the minimum fixing temperature was included was determined. Here, the minimum fixing temperature refers to the lowest temperature among fixing temperatures for which it was determined that cold offset was not occurred.

Specifically, a bias of the evaluation apparatus was adjusted such that a toner application amount to recording paper was 1.0 mg/cm$^2$. An unfixed solid image was formed on printing paper (printing paper of 90 g/m$^2$) while conveying the paper at a linear velocity of 200 mm/second.

The printing paper on which the unfixed solid image had been formed was passed through a fixing device of the evaluation apparatus. At this time, a temperature of the fixing device of the evaluation apparatus (specifically, a temperature of a fixing roller included in the fixing device of the evaluation apparatus) was increased from 100° C. by increments of 5° C. to increase the fixing temperature within a range from 100° C. to 200° C. by increments of 5° C. Thus, solid images (of 21 types) fixed at respective fixing temperatures were obtained.

Whether or not cold offset occurred was determined by performing a fold-rubbing test using each of the obtained solid images. Specifically, the recording paper on which the solid image had been fixed was folded in half such that a surface of the recording paper on which the solid image had been fixed was folded inwards. A 1-kg weight covered with cloth was rubbed back and forth five times on the fold of the recording paper. Thereafter, the recording paper was unfolded, and a length of toner peeling (hereinafter referred to as a peeling width) in a part of a folded portion of the recording paper where the solid image had been fixed was measured. When the peeling width was smaller than 1.0 mm, it was determined that cold offset did not occur. When the peeling width was 1.0 mm or larger, it was determined that cold offset occurred. Further, it was determined that the minimum fixing temperature was within a range between the highest temperature among fixing temperatures for which it was determined that cold offset occurred and the lowest temperature among fixing temperatures for which it was determined that cold offset did not occur.

(Measurement of Minimum Fixing Temperature: Evaluation Test)

In the evaluation test, a fixing temperature at which cold offset occurs was determined. Specifically, the temperature of the fixing device of the evaluation apparatus was varied by increments of 1° C. from the highest temperature among the fixing temperatures for which it was determined that cold offset occurred to the lowest temperature among the fixing temperatures for which it was determined that cold offset did not occur. Thus, solid images (of 6 types) fixed at respective fixing temperatures were obtained. Whether or not cold offset occurred was determined by performing the above-described fold-rubbing test using each of the obtained solid images. Thus, the minimum fixing temperature was determined. When the minimum fixing temperature was not higher than 160° C., low-temperature fixability of the toner was evaluated as excellent. When the minimum fixing temperature was higher than 160° C., low-temperature fixability of the toner was evaluated as inferior.

<Method for Evaluating Hot Offset Resistance>

The maximum fixing temperature was determined using the evaluation apparatus used in "Method for Evaluating Low-Temperature Fixability of Toner" described above. Here, the maximum fixing temperature refers to the highest temperature among fixing temperatures for which it was determined that hot offset was not occurred.

Specifically, an unfixed solid image was formed on printing paper using the evaluation apparatus used in "Method for Evaluating Low-Temperature Fixability of Toner" described above. The printing paper on which the unfixed solid image had been formed was passed through the fixing device of the evaluation apparatus. At this time, a temperature of the fixing device of the evaluation apparatus (specifically, a temperature of the fixing roller included in the fixing device of the evaluation apparatus) was increased from 180° C. by increments of 5° C. to increase the fixing temperature within a range from 180° C. to 250° C. by increments of 5° C. Thus, solid images fixed at respective fixing temperatures were obtained.

Thereafter, whether or not hot offset occurred was checked by visual observation. More specifically, whether or not the toner adhered to the circumferential surface of the fixing roller was checked by visual observation. Thus, the maximum fixing temperature was determined. When the maximum fixing temperature was not lower than 200° C., hot offset resistance of the toner was evaluated as excellent. By contrast, when the maximum fixing temperature was lower than 200° C., hot offset resistance of the toner was evaluated as inferior.

<Method for Evaluating Existence of Contamination by Wax>

A printer ("ECOSYS (registered Japanese trademark) FS-C5400DN" manufactured by KYOCERA Document Solutions Inc.) was used as an evaluation apparatus. The evaluation target (unused) was loaded into a developing device for black color of the evaluation apparatus, and the toner (unused) for replenishment use was loaded into a toner container for black color of the evaluation apparatus. Thus, the evaluation apparatus was prepared.

A printing durability test was performed in an environment at a temperature of 20° C. and a relative humidity of 65% RH by printing a sample image of a coverage rate of 5% successively on 100,000 sheets of printing paper (A4 size) using the evaluation apparatus. Thereafter, a photosensitive drum was taken out of the evaluation apparatus. Whether or not the toner adhered to a photosensitive layer of the photosensitive drum was checked by visual observation, and the number of points on the photosensitive layer to which the toner adhered was counted. When the number of points to which the toner adhered was not larger than five, it was determined that generation of a dash mark could be prevented. When the number of points to which the toner adhered was larger than five, it was determined that generation of a dash mark was difficult to prevent.

TABLE 6

| | Toner | Vinyl resin | Acid value (mgKOH/g) Resin component | Acid value (mgKOH/g) Wax component | NMR | Shell layer thickness (nm) |
|---|---|---|---|---|---|---|
| Example 1 | T-1 | Yes | 4.53 | 1.42 | Observed | 29 |
| Example 2 | T-2 | Yes | 4.62 | 1.44 | Observed | 25 |
| Example 3 | T-3 | Yes | 4.85 | 1.40 | Observed | 33 |
| Example 4 | T-4 | Yes | 4.88 | 1.48 | Observed | 26 |
| Example 5 | T-5 | Yes | 4.75 | 1.45 | Observed | 30 |
| Example 6 | T-6 | Yes | 4.81 | 4.98 | Observed | 28 |
| Example 7 | T-7 | Yes | 6.92 | 1.47 | Observed | 29 |
| Example 8 | T-8 | Yes | 4.68 | 1.49 | Observed | 24 |
| Example 9 | T-9 | Yes | 5.02 | 1.43 | Observed | 28 |
| Comparative example 1 | T-10 | No | 4.67 | — | Not observed | 25 |
| Comparative example 2 | T-11 | No | 4.81 | — | Not observed | 24 |
| Comparative example 3 | T-12 | Yes | 4.87 | 0.01 | Not observed | 26 |
| Comparative example 4 | T-13 | Yes | 0.03 | 1.45 | Not observed | 26 |
| Comparative example 5 | T-14 | No | 4.84 | 1.48 | Not observed | 24 |

In Table 6, whether or not the aqueous solution of the oxazoline group-containing polymer was used in "1-2. Shell Layer Formation Process" described above is indicated in the column "Vinyl resin". "Yes" indicates that the aqueous solution of the oxazoline group-containing polymer was used, and "No" indicates that the aqueous solution of the oxazoline group-containing polymer was not used. Acid values of the binder resins contained in the toner particles are indicated in the column "Resin component". Acid values of the wax particles included in the toner particles are indicated in the column "Wax component". Whether or not a triplet signal was observed around a chemical shift δ of 6.5 in the $^1$H-NMR spectrum was indicated in the column "NMR".

TABLE 7

| | Toner | Minimum fixing temperature (° C.) | Maximum fixing temperature (° C.) | Number of points to which toner adhered |
|---|---|---|---|---|
| Example 1 | T-1 | 134 | 220 | 1 |
| Example 2 | T-2 | 140 | 200 | 0 |
| Example 3 | T-3 | 130 | 240 | 4 |
| Example 4 | T-4 | 138 | 210 | 4 |
| Example 5 | T-5 | 156 | 200 | 0 |
| Example 6 | T-6 | 136 | 210 | 0 |
| Example 7 | T-7 | 150 | 220 | 3 |
| Example 8 | T-8 | 158 | 230 | 3 |
| Example 9 | T-9 | 130 | 220 | 2 |
| Comparative example 1 | T-10 | 148 | 200 | 15 |
| Comparative example 2 | T-11 | 152 | 190 | 3 |
| Comparative example 3 | T-12 | 140 | 200 | 45 |
| Comparative example 4 | T-13 | 138 | 200 | 20 |
| Comparative example 5 | T-14 | 136 | 190 | Uncountable |

In table 7, "Uncountable" indicates that the toner adhered to too many points on the photosensitive layer of the photosensitive drum so that the number of the points was uncountable.

The toners T-1 to T-9 (toners according to examples 1 to 9) were positively chargeable and each included a plurality of positively chargeable toner particles. The toner particles each included a toner core, a shell layer covering a surface of the toner core, and a plurality of wax particles. The toner core contained a binder resin and did not contain a wax. The wax particles were each located on a surface of the shell layer. The toner core and each of the wax particles were bonded together through the specific covalent bonds. The toners T-1 to T-9 as described above were excellent in low-temperature fixability and hot offset resistance. Also, in the toners T-1 to T-9, contamination by the waxes was prevented.

What is claimed is:

1. An electrostatic latent image developing toner comprising a plurality of positively chargeable toner particles, wherein the toner particles each include a toner core, a shell layer covering a surface of the toner core, and a plurality of wax particles, the toner core contains a binder resin and does not contain a wax, the wax particles are each located on a surface of the shell layer, the toner core and each of the wax particles are bonded together through covalent bonds within the shell layer, the covalent bonds include a first amide bond and a second amide bond, the shell layer contains a vinyl resin, the vinyl resin includes a constitutional unit represented by formula (1-1) below, a constitutional unit represented by formula (1-2) below, and a constitutional unit represented by formula (1-3) below, an amide bond included in the constitutional unit represented by the formula (1-1) is the first amide bond, and an amide bond included in the constitutional unit represented by the formula (1-2) is the second amide bond, (1-1)

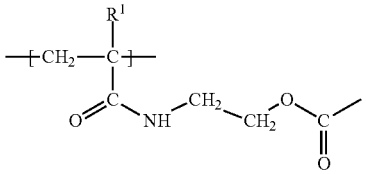

in the formula (1-1), $R^1$ represents a hydrogen atom or an optionally substituted alkyl group, and a dangling bond of a carbon atom bonded with two oxygen atoms is connected with an atom constituting the binder resin, (1-2)

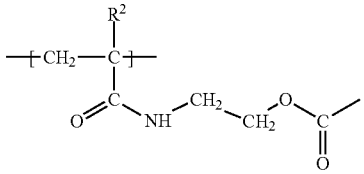

in the formula (1-2), $R^2$ represents a hydrogen atom or an optionally substituted alkyl group, and a dangling bond of a carbon atom bonded with two oxygen atoms is connected with an atom constituting a wax contained in the wax particles, (1-3)

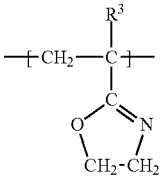

in the formula (1-3), $R^3$ represents a hydrogen atom or an optionally substituted alkyl group.

2. The electrostatic latent image developing toner according to claim 1, wherein the shell layer further contains a positively chargeable resin and a hydrophobic resin, the positively chargeable resin has stronger positive chargeability than the binder resin, and the hydrophobic resin has stronger hydrophobicity than the positively chargeable resin.

3. The electrostatic latent image developing toner according to claim 2, wherein the vinyl resin is present in a portion of the shell layer located between the toner core and each of the wax particles, and the positively chargeable resin and the hydrophobic resin cover a surface region of the toner core exposed from the vinyl resin.

4. The electrostatic latent image developing toner according to claim 3, wherein the shell layer has an extended portion, the extended portion extends from the portion of the shell layer located between the toner core and each of the wax particles toward an outer side of the toner particle in a radial direction thereof, and covers a part of a surface of at least one of the wax particles, and the extended portion contains the vinyl resin.

5. The electrostatic latent image developing toner according to claim 1, wherein an acid value of the binder resin is at least 1 mgKOH/g and no greater than 10 mgKOH/g, and an acid value of the wax contained in the wax particles is at least 1 mgKOH/g and no greater than 10 mgKOH/g.

* * * * *